US008956245B2

(12) United States Patent
Brandt

(10) Patent No.: US 8,956,245 B2
(45) **Date of Patent: *Feb. 17, 2015**

(54) PUTTER HEAD WITH MAXIMAL MOMENT OF INERTIA

(76) Inventor: Richard A. Brandt, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/559,327

(22) Filed: Jul. 26, 2012

(65) Prior Publication Data

US 2012/0289362 A1 Nov. 15, 2012

Related U.S. Application Data

(63) Continuation of application No. 12/482,835, filed on Jun. 11, 2009, now Pat. No. 8,251,836.

(60) Provisional application No. 61/061,440, filed on Jun. 13, 2008.

(51) Int. Cl.
*A63B 53/04* (2006.01)
*A63B 53/00* (2006.01)

(52) U.S. Cl.
CPC ..... *A63B 53/007* (2013.01); *A63B 53/0487* (2013.01); *A63B 2053/0491* (2013.01)
USPC ..... 473/340

(58) Field of Classification Search
USPC ..... 473/324–350
See application file for complete search history.

(56) References Cited

U.S. PATENT DOCUMENTS 3,516,674 A 6/1970 Scarborough
3,966,210 A 6/1976 Rozmas
4,010,958 A 3/1977 Long
4,128,242 A 12/1978 Elkins, Jr.
4,693,478 A 9/1987 Long
4,898,387 A 2/1990 Finney
4,984,799 A 1/1991 Finney
4,995,612 A 2/1991 Finney
4,999,000 A 3/1991 Finney
5,060,950 A 10/1991 Finney
5,080,365 A 1/1992 Winchell
5,308,067 A 5/1994 Cook
5,340,106 A 8/1994 Ravaris
5,558,332 A 9/1996 Cook
5,938,543 A 8/1999 McGeeney et al.
6,409,613 B1 6/2002 Sato
6,435,979 B1 8/2002 Mounfield, Jr.
6,488,595 B1 12/2002 Grace
6,951,517 B2 10/2005 Lindsay
6,974,394 B1 12/2005 Tang et al.
7,004,849 B2 2/2006 Cameron (Continued)

OTHER PUBLICATIONS

Chinese Office Action (with English translation) dated Mar. 28, 2012 for Chinese application No. 200980127548.X.

(Continued)

*Primary Examiner* — Alvin Hunter

(74) *Attorney, Agent, or Firm* — Ohlandt, Greeley, Ruggiero & Perle LLP

(57) ABSTRACT

A putter head has a front that strikes a golf ball during putting, a length a, a width b, a weight W, and a moment of inertia I. The width extends along a horizontal width axis perpendicularly intersecting the front of the putter head. The length extends along a horizontal length axis perpendicularly intersecting the horizontal axis. The dimensions are, for example, a≤7 inches, b≤a, and $I/Wa^2>0.30$.

12 Claims, 12 Drawing Sheets

(56) References Cited

U.S. PATENT DOCUMENTS

| | | | | |
|---|---|---|---|---|
| 7,018,304 | B2 | 3/2006 | Bradford | |
| 7,077,758 | B2 | 7/2006 | Rohrer | |
| 7,244,191 | B2 | 7/2007 | Tang et al. | |
| 7,270,609 | B2 | 9/2007 | Yamaguchi et al. | |
| 7,387,580 | B2 | 6/2008 | Hasegawa | |
| 7,413,517 | B2 | 8/2008 | Butler, Jr. et al. | |
| 7,431,660 | B2 | 10/2008 | Hasegawa | |
| 7,670,232 | B2 | 3/2010 | Franklin et al. | |
| 8,251,836 | B2 * | 8/2012 | Brandt | 473/340 |
| 2006/0100030 | A1 | 5/2006 | Hasegawa | |

OTHER PUBLICATIONS

Second Office Action dated Dec. 13, 2012 for corresponding Chinese patent application No. 200980127548.X with English translation, pp. 15.

International Search Report and Written Opinion dated Aug. 14, 2009 from PCT/US2009/047017.

Canadian Office Action dated Nov. 18, 2013 corresponding to Canadian Patent App. 2,727,274, 3 pp.

English translation of Japanese Office Action dated Feb. 4, 2013 corresponding to Japanese Patent App. No. 2011-513684, 4 pp.

* cited by examiner

PUTTER HEAD WITH MAXIMAL MOMENT OF INERTIA

CROSS-REFERENCE TO RELATED APPLICATIONS

The present application is a continuation of U.S. patent application Ser. No. 12/482,835, filed on Jun. 11, 2009, which in turn claims the benefit of U.S. Provisional Patent Application Ser. No. 61/061,440, filed on Jun. 13, 2008, the entire disclosure of which is incorporated by reference herein.

BACKGROUND OF THE PRESENT DISCLOSURE

1. Field of the Present Disclosure

The present disclosure relates to design of a head of a putter used in the game of golf.

2. Discussion of the Related Art

When a putter head hits a golf ball, the putter exerts a force on the ball, and the ball exerts an equal force on the putter in the opposite direction. In general, the force exerted on the putter by the ball does two things. It slows down the forward linear motion of the putter, and it causes the putter head to rotate about the vertical axis through its center of mass (COM).

This rotation of the putter head is undesirable because it produces an error in the direction and speed of the ball. If the face of the incident head is perpendicular to the desired initial direction of the ball, as it should be, then the error arises because the rotated head will point away from this desired direction. During the brief time that the ball is in contact with the face of the putter head, the putter head will have rotated through a small angle so that, when the ball leaves the face of the putter head, it will move in a direction which is approximately perpendicular to the rotated face instead of the direction perpendicular to the original face. Also, because some of the kinetic energy of the incident putter head goes into the rotational energy acquired by the putter head, the speed of the struck ball will be less than anticipated.

However, if ball is hit directly in front of the COM of the putter head, then there will be no induced rotation about the COM axis, and the above direction and speed errors will be avoided. Of course, the ball is not often hit directly in front of the COM of the putter head. Thus, the moment of inertia (MOI) of the putter head about the vertical axis through the COM of the putter head is important. (This MOI is defined as $\Sigma m_i r_i^2$, where each mass element $m_i$ is multiplied by the square of the perpendicular distance $r_i$ between the position of the element and the chosen vertical axis that intersects the COM of the putter head.) For an impact that is not directly in front of the COM of the putter head, the larger the MOI, the smaller the angular error. In other words, the larger the MOI, the larger the area on the clubface that produces an acceptable hit. This relationship is why the MOI is so important.

USGA regulations restrict the size of a putter head, but not the weight or MOI of the putter head. Professional golfers consistently hit the ball very close to the point on the putter face directly in front of the COM of the putter head. This point may be referred to as the COM-point or "sweet spot" on the face of the putter head.

Many articles, books, and patents erroneously claim that the sweet spot is the point in front of the center of percussion (COP) of the putter head. The confusion arises because the COP of the putter head is the point where an impact does not induce a reaction at the shaft insertion point into the putter head. An impact at the COP of the putter head, therefore, does not eliminate a putter head rotation, but instead creates a rotation about the COM of the putter head, since this created rotation must cancel the translational motion at the shaft induced by the impact. This rotation causes the ball to leave the clubface in the wrong direction. The sweet spot of the head is therefore the COM, not the COP, of the putter head.

Amateur golfers, on the other hand, usually hit the ball at a point on the clubface that is a fair distance (often 0.5" and sometimes over 1") from the COM point of the putter head. It is, therefore, in the interest of most golfers to use a club with as large a MOI as possible.

DETAILED DESCRIPTION OF THE DISCLOSURE

Figure 1A:
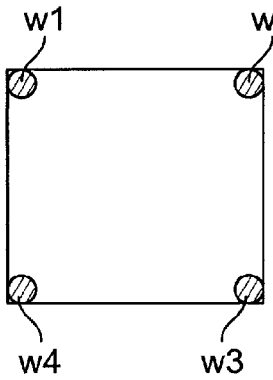
FIG. 1 illustrates three putter head configurations useful in explaining the present invention.

According to embodiments of putter heads described herein, the putter heads are characterized by extremely large moments of inertia (MOI). These MOI values are much larger than those of putter heads currently on the market or disclosed in prior art. These large MOI values may be achieved in one or more of four novel ways.

First, the putter head includes two to four relatively heavy "load" elements placed in locations as far as possible from the putter head center of mass (COM) and interconnected by a minimal number of relatively light "connecting elements," which including a face plate and shaft holder.

Second, the shapes of these elements are chosen to increase the MOI of the putter head. These shapes, and their distributions within the putter head, result in novel appearances of the putter heads.

Third, the dimensions of the load elements (large in the vertical direction and small in the horizontal directions) are chosen to increase the MOI of the putter head. These dimensions also give rise to novel appearances of the putter heads.

Fourth, the weights of the load elements are determined, by mathematical optimization calculations, to maximize the MOI of the putter head, given the configuration, overall weight, and overall size of the putter head. (The sizes are consistent with USGA regulations.)

One way to obtain a putter head with a large MOI is to give it a large weight. Golfers, however, typically prefer a head weight within a very limited range, such as between 11 and 16 ounces. (A too-light head requires a swing speed that is relatively large and difficult to control, whereas a too-heavy head requires a swing speed that is relatively small and difficult to adjust.) A large MOI, therefore, should be achieved by distributing the desired weight within the putter head so that it is as far as possible from the COM of the putter head. The relevant quantity to consider is, therefore, the ratio I/W wherein I represents MOI and W represents weight. Putters are disclosed herein that have large values of I/W, values that are much larger than those previously obtained.

One way to achieve large I/W values is to give the putter head a relatively large size and placing most of its weight far from its COM. There are, however, practical and official limitations on the acceptable size of a putter head. The USGA limits the maximum head size (see below), and, in any case, a putter head that is too large looks and feels awkward and is difficult to control.

The maximum linear dimension of a given putter head may be denoted as a. The most relevant quantity to consider is, therefore, the dimensionless ratio $I/Wa^2$. Putter heads are described herein having the largest possible values of this ratio.

The dimensions of the putters as disclosed herein are compliant with the USGA regulations. The USGA putter head dimension limits are on the overall length OL, the face length FL, the overall width OW, and the overall height OH. The restrictions are that OL is greater than OW but at most 7 inches, FL is at least two-thirds of OW and at least one-half of OL, and OH is at most 2.5 inches. The maximum linear dimension a is, therefore, the OL. OW is referred to herein as b, OH is referred to herein as h, and FL is referred to herein as f. Thus, the restrictions on the putter head are $b \le a \le 7''$, $f \ge 2b/3$, $f \ge a/2$, and $h \le 2.5''$. A compliant putter head must, therefore, fit within a rectangular box of length $a \le 7''$, width $b \le a$, and height $h \le 2.5''$.

The SI unit of MOI is kg-$m^2$. However, because the USGA regulations, and the specifications given by most club manufacturers, are given in English units (ounces and inches), MOI units are specified herein as oz-$in^2$. Thus, MOI as used herein, therefore, uses the weights, rather than the masses, of the material elements in the MOI definition. In other words, MOI as used herein is the product of the SI MOI and the acceleration of gravity (32 $ft/s^2$).

It is shown in the following that the theoretical absolute maximum value of $I/Wa^2$ for a putter head is 0.50. For putter heads compliant with USGA regulations ($a \le 7''$), this absolute maximum value of $I/Wa^2$ implies that the maximum value of I/W is 24.5 $in^2$.

These theoretical putter heads consist of point weights alone, without a faceplate, connecting elements, or a shaft holder. Realistic putter heads, which include these elements and have non-point weights, cannot of course attain these maximum values. However, a realistic putter head with $I/Wa^2$ as large as 0.42 and an I/W, therefore, as large as 21 $in^2$ is possible.

For comparison, one of the larger putter heads on the market has an I/W of about 6 $in^2$. Although many patents claim to disclose putter heads with large values of I/W, none includes calculated values of I/W for realistic putters as large as those described herein.

To produce a desired putt with a conventional putter, a golfer must hit the ball with the correct swing speed, with the correct swing direction, and at the sweet-spot on the putter head face. For putter heads with MOI ratios as large as those described herein, this last requirement is unnecessary. The entire putter head face is the sweet-spot, and the hit ball will proceed in the intended direction for virtually any impact point. The golfer is thus free to concentrate on only the first two requirements.

In order to determine the theoretical upper limit on the possible values of $I/Wa^2$ for putter heads, "theoretical" heads are considered. These heads are mathematical constructs consisting of nothing except point masses separated as far possible from each other and from the COM of the system. The connecting, faceplate, and shaft-attachment elements necessary for a realistic putter are absent in the theoretical putter. The presence of any such element would decrease the value of I/W because they would add weight closer to the COM.

Figure 1B:
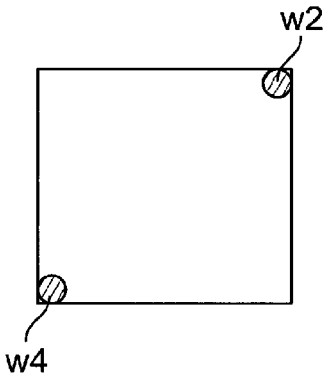
Figure 1C:
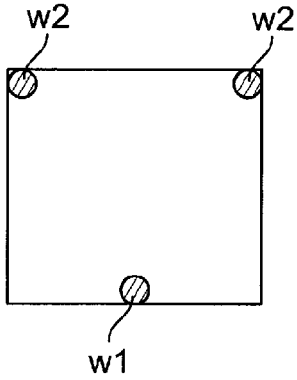

In order to comply with USGA regulations, the point masses must lie within a rectangular box of length $a \le 7''$, width $b \le a$, and height $h \le 2.5''$. The optimal choice is b=a, and only the case where the mass points lie on the perimeter of a square of side a need be considered. The point masses must reside at the corners of this square in order to maximize the separation distances. This construct is illustrated in FIG. 1(*a*) and FIG. 2. The weights in the corners are w1, w2, w3, and w4, and the fixed total weight is W=w1+w2+w3+w4.

Figure 2:
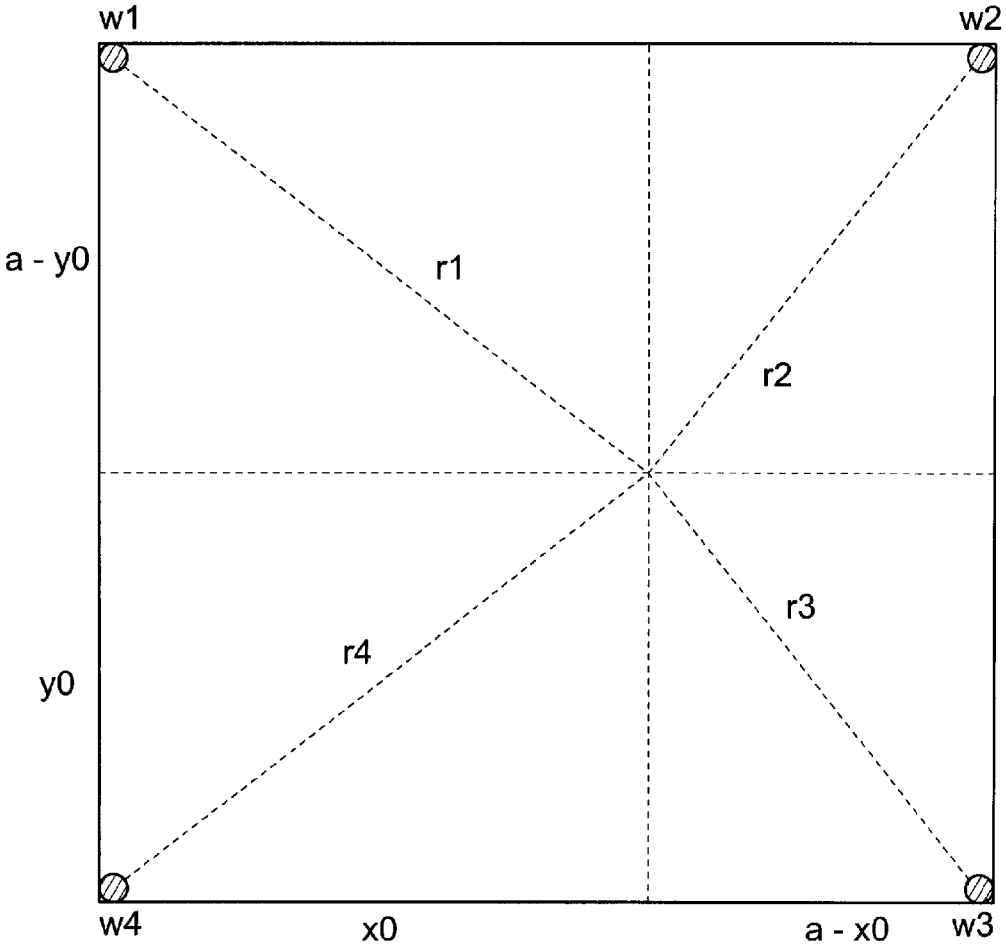
FIG. 2 illustrates a putter head configuration useful in explaining the present invention.
Figure 3A:
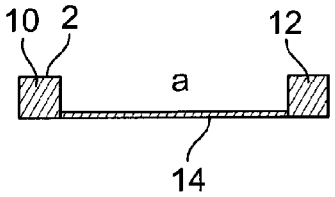
FIG. 3a (Prior Art)
FIG. 3 illustrates various prior art putter head designs.
Figure 3B:
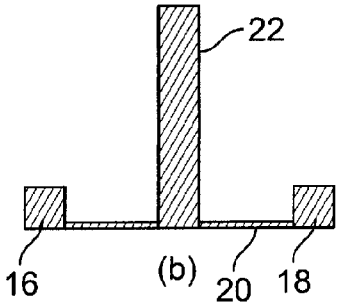
FIG. 3b (Prior Art)
Figure 3C:
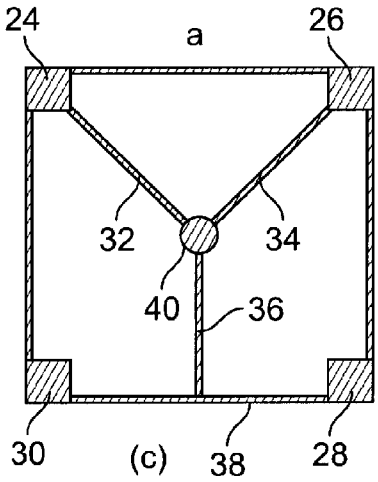
FIG. 3c (Prior Art)
Figure 3D:
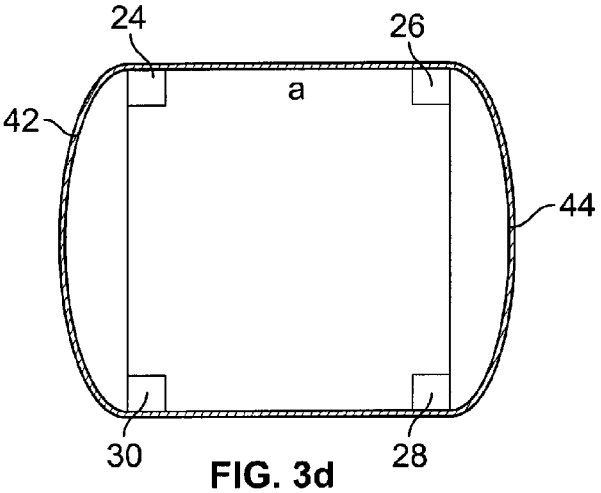
FIG. 3d (Prior Art)
Figure 3E:
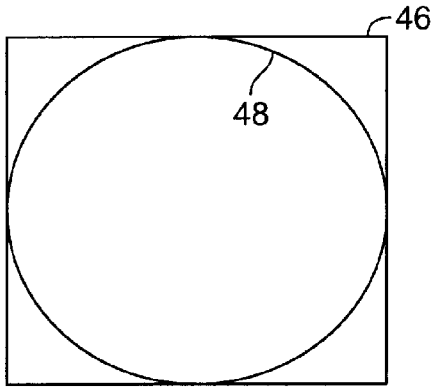
FIG. 3e (Prior Art)
Figure 3F:
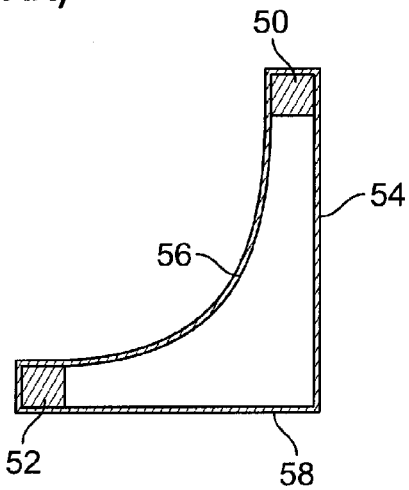
FIG. 3f (Prior Art)
Figure 4A:
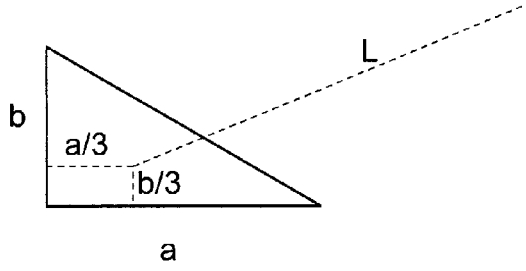
FIG. 4 illustrates shapes of loads and connecting elements that can be used in connection with putter heads.
Figure 4B:
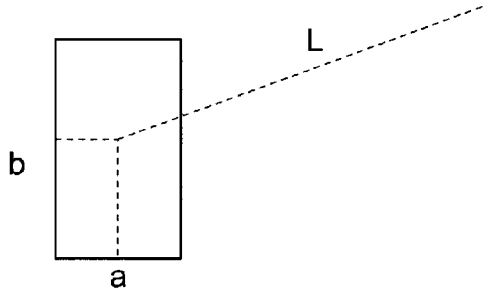
Figure 4C:
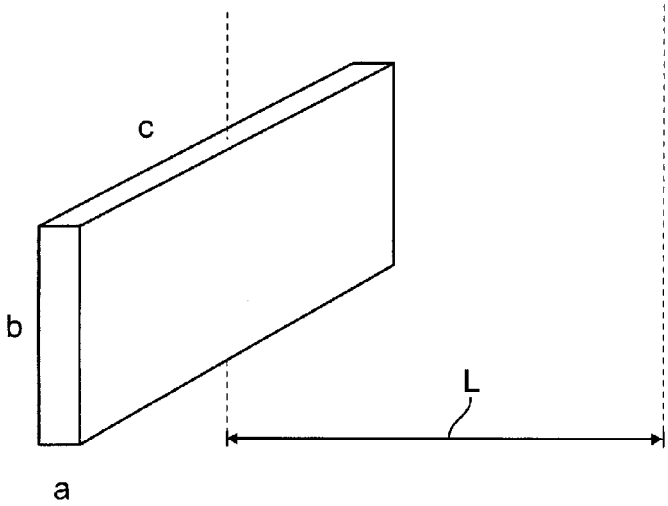
Figure 4D:
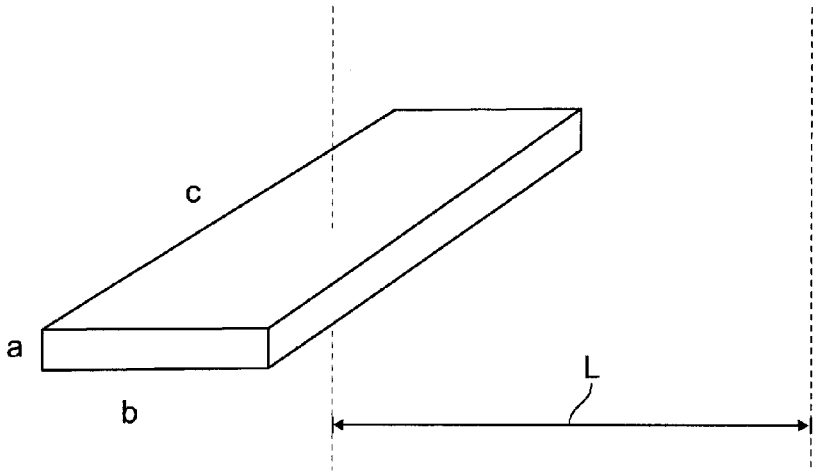
Figure 4E:
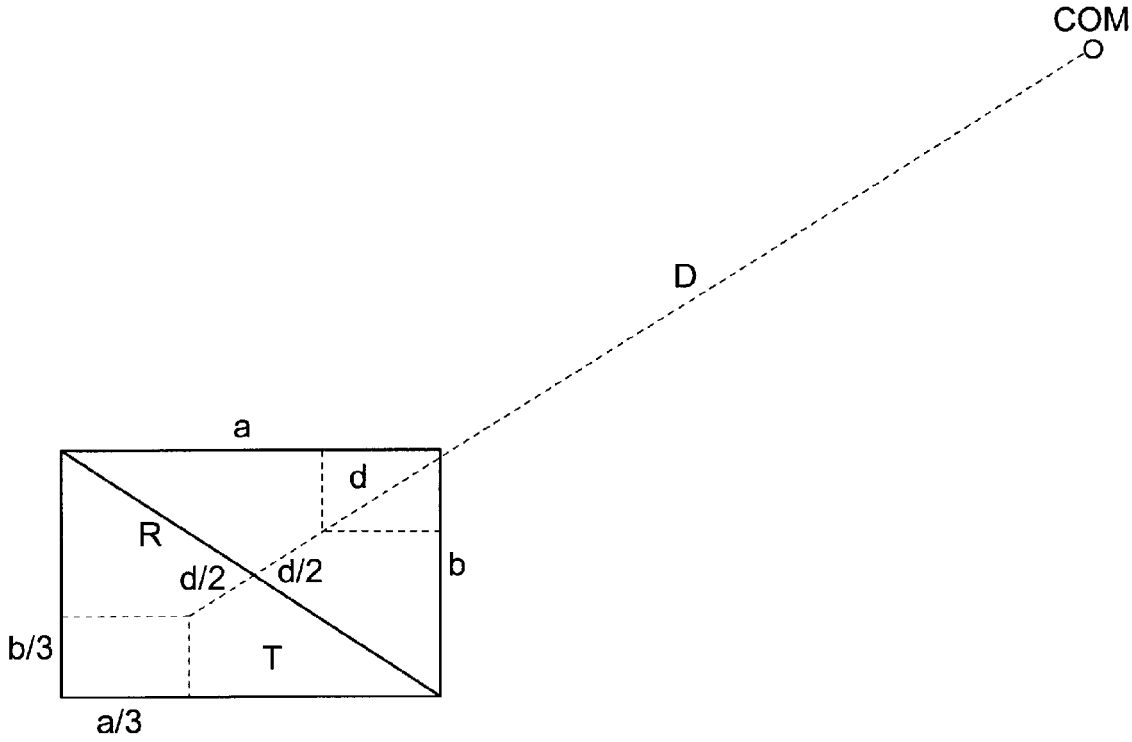
Figure 5A:
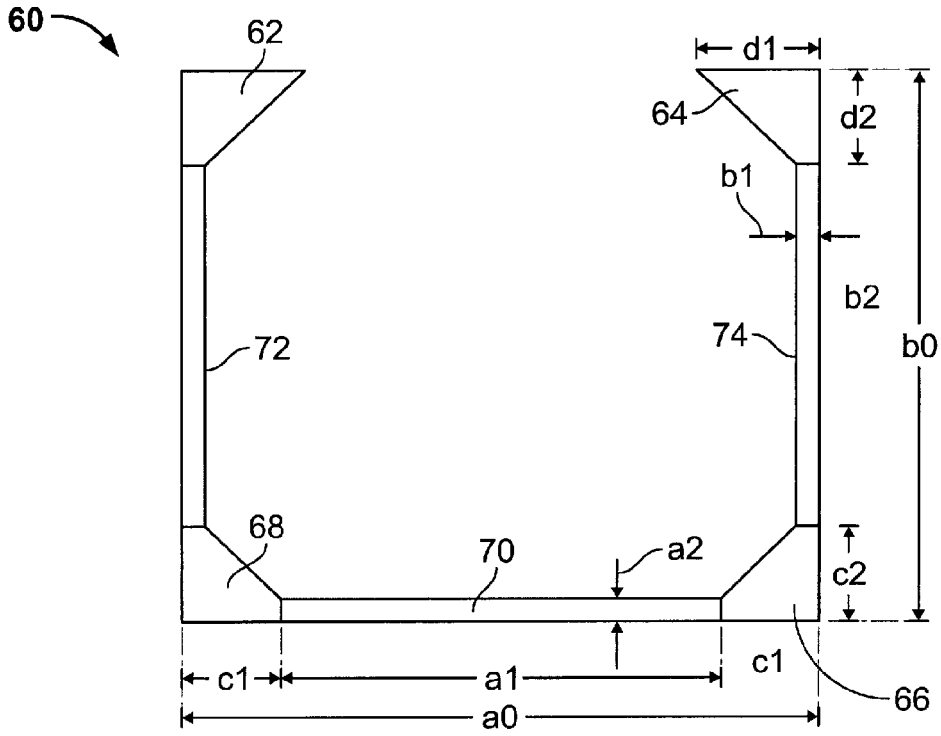
FIG. 5 illustrates a four-load putter head, a three-load putter head, and a two-load putter head that achieve very large values of MOI.
Figure 5B:
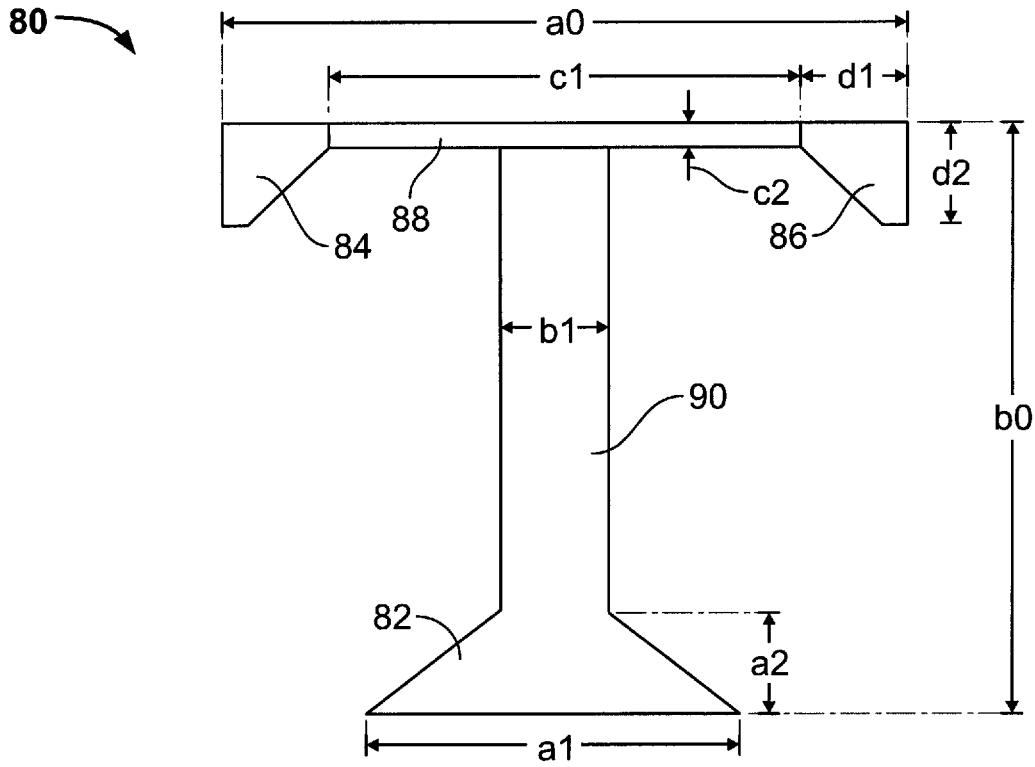
Figure 5C:
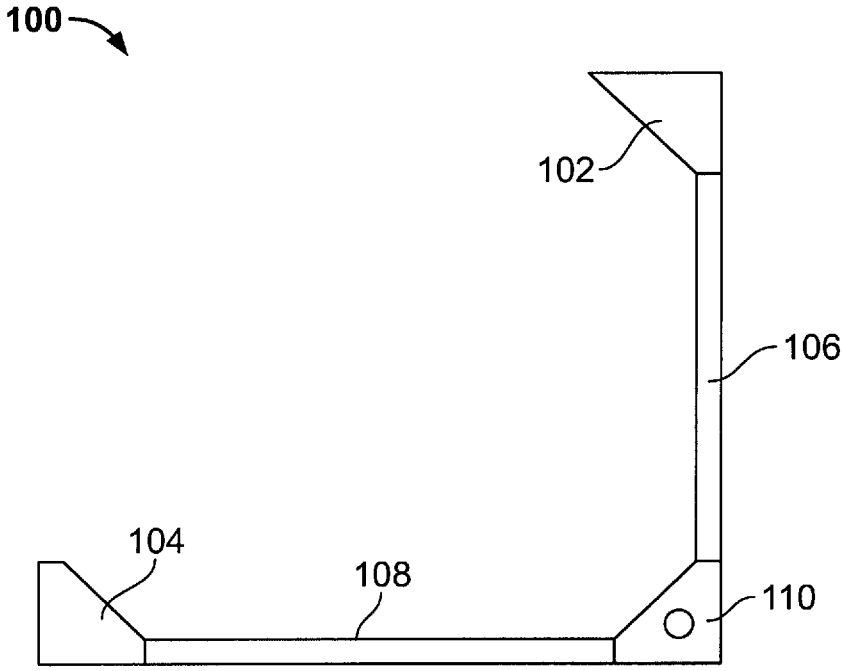
Figure 5D:
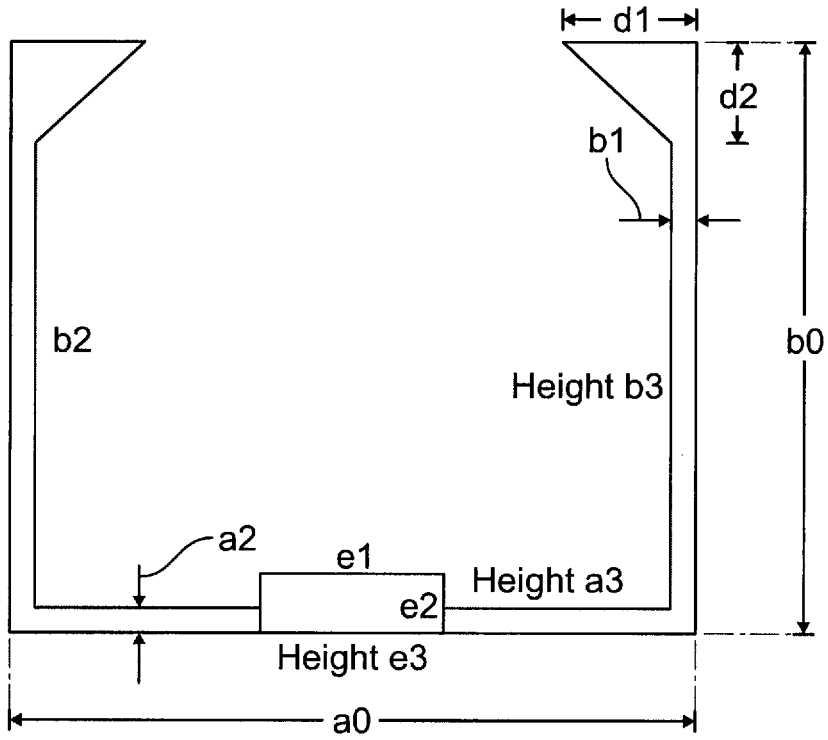

In the coordinate system centered at w3 of FIG. 2, the coordinates x0 and y0 of the COM are given by the following equations:

$$x0=a(w2+w3)/W,$$

$$y0=a(w1+w2)/W.$$

The MOI of the system about the transverse axis through the COM is given by the following equation;

$$I(w1,w2,w3)=\Sigma wi*ri^2,$$

where the sum is over i=1, 2, 3, 4 and ri is the distance between wi and the COM. The maximum value of I is given by the solution of the three simultaneous equations $$\partial I/\partial wi=0, \text{ for } i=1,2,3.$$

The solution is given by the following equation:

$$w1=w2, w3=w4=W/2-w1,$$

and the corresponding maximum value is given by the following equation:

$$I_{max}=Wa^2/2.$$

This is the largest possible value of the MOI for a putter head of weight W and length a. The COM is at the center of the square (x0=y0=a/2).

The maximum value of I/W is, therefore, $a^2/2$, and the maximum value of $I/Wa^2$ is, therefore, ½=0.50. These values serve as upper limits on the MOIs of realistic putter heads. For USGA compliant putter heads, a is at most 7", and so the following values are obtained:

$$(I/W)_{max}=a^2/2=49/2=24.5 \text{ in}^2,$$

$$(I/Wa^2)_{max}=½=0.50.$$

The goal is realistic putter heads, which include faceplates, connecting elements, and shaft holders, that have MOI values as close to these upper-limit values as possible.

Of special interest is the equal weight case w1=w2=w3=w4=W/4. The theoretical putter head is then left-right symmetric, as is the case of most realistic putter heads on the market. Another special case of interest is the novel choice w1=w3=0, w2=w4=W/2. This choice, consisting of only two loads, results in a theoretical putter head that is far from left-right symmetric. It is illustrated in FIG. 1(*b*). Although it looks unusual, this type of putter head has the advantage of requiring fewer connecting elements when it is made into a realistic putter head.

There is no optimal theoretical putter head with only three weights because the optimal weight choices do not include the case when only one of the wi is zero. There is, however, an interesting class of a three-load putter head which has a very large, but not optimally large, MOI. The system is illustrated in FIG. 1(*c*). Two equal weights w2 reside in the upper two corners, and a single weight w1 resides at the center of the lower side of the square.

In this latter case, the total weight W=w1+2w2 and the length a are fixed, and the value of the weight ratio s=wI/W that maximizes the ratio I/Wa$^2$ can be determined. The COM coordinates are given by the following equations:

$$x0=a/2,$$

$$y0=a(1-s),$$

and the MOI ratio is $$I/Wa^2=\tfrac{1}{4}+3s/4-s^2f(s).$$

The optimal choice of s is given by f'(s)=0. The solution is s=⅜, so that $$w1=3W/8,$$

$$w2=5W/16,$$

$$y0=5a/8,$$

and $$(I/Wa^2)_{max}=f(3/8)=25/64=0.391.$$

The MOI ratio is thus 22% less than the optimal value of 0.50 for the optimal four and two load putter heads, it will be shown below that the difference is rather less for the realistic putter heads based on these platforms.

When a faceplate is added to the bottom side of the four or two load platforms of FIGS. 1(*a*) and 1(*b*), the ratio I/W is reduced because weight must be added closer to the COM. But when a faceplate is added to the bottom side of the three load platform of FIG. 1 (*c*), the ration I/W is reduced less because there already is a weight at this location. However, if that faceplate is instead added to the top side of the three load platform, there is no such advantage.

The earliest attempts to increase putter head MOIs placed loads at the heel and toe ends of blade shaped designs. The corresponding theoretical putter head is depicted in FIG. 3(*a*). The optimal choice for such a configuration is to have equal weights 10 and 12 (each having a weight of W/2) at opposite ends of an element 14 of length a. Then I/Wa$^2$=¼=0.250. This is much less than the 0.500 value for the four and two load cases or the 0.391 value for the three load case discussed above.

The benefits of putters with increased MOIs have long been known. The earliest attempts involved modified blade type putter heads with weights added at the toe and heel locations of the face. This type of arrangement is illustrated in FIG. 3(*a*). Typical patents for putters of this type are Scarborough U.S. Pat. No. 3,516,674, Rozmas U.S. Pat. No. 3,966,210, and Finney U.S. Pat. No. 4,898,387. As explained above, the maxim MOI ratio that can be expected from such putter heads is I/Wa$^2$<0.25. Finney claims to achieve the value is I/Wa$^2$=0.17 for an a=5" length and W=10.6 oz weight head. This is reasonably close to the theoretical maximum value for his type of putter design.

It was later realized that the MOIs could be further increased by adding weight rearward from the center of the putter face. Thus, the putter face has weights 16 and 18 at opposite ends of an element 20 of length a and a third weight 22 rearward from the center of the element 20. This type of arrangement is illustrated in FIG. 3(*b*). A well-researched example of this type of putter head is disclosed by Winchell in U.S. Pat. No. 5,080,365. Winchell claims to achieve an I/W value of 1.94 in$^2$ for an a=5" length and a W=1 lb weight.

As shown above, the largest possible theoretical value of I/W for a three-load putter head is 0.391 a$^2$, which is 9.78 in$^2$ for a=5". Below is a discussion of why a realistic three-load a=5" putter head can achieve an I/W=8-9 in$^2$. There are four reasons that the three load putter heads described herein achieve significantly higher values than Winchell's. (1) The shapes of the loads and connecting elements are better chosen. (2) The dimensions of the loads are better chosen. (3) The weight ratios of the loads are optimally chosen. (4) The two-weight line at the rear of the head and the third weight at the center of the faceplate are placed more optimally.

A four-load putter head was disclosed by Long in U.S. Pat. No. 4,010,958. A preferred embodiment of Long's head is illustrated in FIG. 3(*c*). Square loads 24, 26, 28, and 30 are placed in the four corners of a (typically 5" by 5") square and interconnected by three lower-density tubular struts 32, 34, and 36 and a faceplate 38. A shaft 40 of the putter is inserted at the center of the square and is connected to the back loads 24 and 26 and the faceplate 38 by the three struts 32 34, and 36.

The weights of the loads 24, 26, 28, and 30 are unspecified except for the requirement that the weights of the front loads 28 and 30 are less than the weights of the back loads 24 and 26 in order that the COM resides at the center 40 of the square. Long does not numerically evaluate MOI values, but it can be calculated that the construction of FIG. 3(*c*) yields I/Wa$^2$ values of at most 0.30.

While this value is impressive, it is not impressive enough and the four-load putter heads disclosed herein have I/Wa$^2$ values over 0.42, which is a 40% increase over Long's putter head. As discussed above, the theoretical upper-limit of I/Wa$^2$ for a four-load head was shown in Section 2 to be 0.50.

The novel features of the putter heads disclosed herein, and the reasons that their values are much larger than Long's and are much closer to the theoretical maximum value, are the following: (1) the weights of the loads for the putter heads disclosed herein are mathematically chosen to maximize I/Wa$^2$; (2) the number, shapes, and locations of the connecting elements (struts) of the putter heads disclosed herein are chosen to maximize I/Wa$^2$; and, (3) the shapes and dimensions of the loads of the putter heads disclosed herein are chosen to maximize I/Wa$^2$.

A different type of putter head is described by Rohrer in U.S. Pat. No. 7,077,758. Rohrer asserted that his designs achieved higher MOIs than Long's, and in fact achieved maximum values of I/Wa$^2$. This claim 1s incorrect.

Rohrer describes a putter head in which the bulk (at least 70%) of the weight is concentrated within a circular ring concentric with the COM. Rohrer claims that, for a given size and weight, his putter head has a MOI that is 34% larger then Long's. This claim 1s based on the comparison illustrated in FIG. 3(*d*). This figure compares a Long head, having of length a and in which the weights of the loads 24, 26, 28, and 30 are concentrated in the four corners, to a Rohrer head, having face length a and in which the weights are concentrated in two protruding circular segments 42 and 44.

The theoretical limit (zero weight volumes, no connectors of faceplate) for the value of I/Wa$^2$ is the same, 0.50, for each of these heads. However, the comparison of the two heads is unfair because the size of the Rohrer head is obviously much larger than that of the Long head.

The USGA places upper limits on the overall length a and width b of the head (b≤a≤7"), not on just the face length. Therefore, if a=7", the illustrated Long putter is compliant with USGA requirements, but the Rohrer putter is not. The fair comparison between the putters must compare heads of equal overall size (and weight). This comparison is illustrated in FIG. 3(*e*). The value of $I/Wa^2$ for the theoretical Long putter 46 is again 0.50, but that for the Rohrer putter 48 is only 0.25, which is the same as for the simple blade putter of FIG. 3(*a*).

Rohrer also claims that the MOI of his putter head is further increased relative to Long's putter head because his shaft insertion point is relatively far from the COM. This claim 1s also unfair because the contact time between a struck golf ball and a putter head is too short for the presence of most of the shaft to be felt.

The conclusion from this analysis is, therefore, that, for a given weight and size, the Long head has a 100% larger MOI than the Rohrer head and a 40% smaller MOI than the four-load head described herein.

A two-load putter head is described by Sato in U.S. Pat. No. 6,409,613 and is illustrated in FIG. 3(*f*). This head is L-shaped, with cylindrical loads 50 and 52, of unspecified weight, placed in opposite corners and connected by lower-density arms 54 and 56 and a faceplate 58. Sato does not address the MOI concept, but does state that the rotation of his putter head caused by an impact away from the sweet spot is decreased relative to a blade-type head. He argues that this decreased rotation is because the exerted torque on his putter head is less because the COM is further back from the face. This argument is incorrect.

Torque is the product of the applied force and the perpendicular distance between the force vector and the vertical axis through the COM, and thus torque depends on the distance between the impact point and the sweet spot on the face, but is independent of the distance of the COM behind the sweet spot on face.

Although Sato's reasoning is incorrect, his conclusion about decreased rotation is correct because the MOI of his head is relatively large. He does not numerically evaluate MOI values, but the $I/Wa^2$ values for his construction can be calculated to be at most 0.27. This $I/Wa^2$ value is large, but the two-load putter heads described herein have $I/Wa^2$ values as high as 0.41, a 52% increase. The theoretical upper-limit of $I/Wa^2$ for a two-load head 0.50 as described above.

The novel features of the two-load putter heads described herein, and the reasons that their $I/Wa^2$ values are much larger than Sato's, and much closer to the theoretical maximum value, are the following: (1) the weights of the loads for the two-load putter heads described herein are mathematically chosen to maximize $I/Wa^2$; (2) the shapes and locations of connecting elements for the two-load putter heads described herein are chosen to maximize $I/Wa^2$; and, (3) the shapes and dimensions of the loads for the two-load putter heads described herein are chosen to maximize $I/Wa^2$.

In one embodiment, the putter heads under consideration herein incorporate four types of components: loads, a faceplate, connecting elements, and a shaft holder. The first three of these are discussed more fully herein. The shaft holder is a simple low-weight addition that will be discussed after the first three elements. These components are situated within a rectangular box of length a0≤7", width b0≤a0, and height c0≤2.5". For simplicity, each component is assumed to have a constant density, although such an assumption is not required.

Regarding the load components first, these must be placed as far as possible from the vertical axis through the putter head COM in order to achieve the largest possible MOI. The loads, therefore, will reside at the corners of the base a0×b0 rectangle and extend upwards in the perpendicular direction. Likewise, the COM of each load must be as far as possible from the putter head COM. Among the practical load shapes, the triangular shape is considered herein. Any other simple shape would move the load COM and the putter head COM closer together, as demonstrated below.

A typical triangular load is illustrated in FIG. 4(*a*). The base dimensions are a×b and the height of the load coming out of the page is denoted as c. Although this triangular shape is a preferred design for the base of the load, the putter heads disclosed herein will yield very large MOI ratios for a variety of other shapes.

Another novel feature of the putter heads disclosed herein is the exploitation of the generous USGA limit of 2.5" for the height of the putter head. Whatever the shape of the base of the load, the use of load heights near this upper limit significantly contributes to the achievement of very large MOI ratios. The loads used in prior art putter heads do not make use of this freedom. If more of the load is in the vertical direction, then the base of the load can be smaller, and so more of the load can be farther from the COM, leading to a larger MOI ratio.

The simplest shape for the connecting elements is a solid rectangular box. The rectangular base of such an element is illustrated in FIG. 4(*b*). Because they are closer to the putter head COM, these connectors must be as light as possible to minimize their effect in decreasing the overall MOI ratio I/W. They must, however, be sufficiently strong to securely connect the other elements.

There are two possibilities for the orientation of these connectors, as illustrated in FIGS. 4(*c*) and 4(*d*). In FIG. 4(*c*), the shorter side of the connector, of length a, is in the horizontal direction, and the longer side, of length b, is in the vertical direction. These choices are reversed in FIG. 4(*d*). Each of these connector possibilities has width c in the backward direction. The connector of FIG. 4(*c*) would be farther from the putter head COM, but it has the smaller MOI about the vertical axis through its COM, whereas the connector of FIG. 4(*d*) would be closer to the putter head COM, but it has the larger MOI about the vertical axis through its COM. It will be shown below that it is the connector of FIG. 4(*c*) that achieves the largest putter head MOI ratio.

To specify distances, the x-axis (1-axis) is chosen to be along the (toe-heel) length of the putter face, the y-axis (2-axis) is chosen to be along the (front-back) width of the putter face, and the z-axis (3-axis) is chosen to be in the vertical direction. The COM of the triangular solid load having the base shown in FIG. 4(*a*) is at x=a/3, y=b/3, and z=c/2. The MOI ratio of this solid about the vertical axis through its COM is given by the following equation:

$$I_{T0}/W_T=(a^2+b^2)/18.$$

The COM of the rectangular solid connector with base shown in FIG. 4(*b*) is at x=a/2, y=b/2, and z=c/2. The MOI ratio of this solid about the vertical axis through its COM is given by the following equation:

$$I_{R0}/W_R=(a^2+b^2)/12.$$

The MOI ratio of either component (C=T or R) about the vertical axis through the putter head COM is given by the parallel-axis theorem and is given by the following equation:

$$I_C/W_C=I_{C0}/W_C+l^2.$$

where l is the distance between the vertical axis through the load or connector COM and the vertical axis through the putter head COM.

It can now be confirmed that the triangular load achieves a larger MOI ratio about the putter head COM than a rectangular load of the same dimensions and weight W. FIG. 4(*e*) depicts a triangular load (the lower right triangle "T" of base a and height b), and a rectangular load (the full rectangle "R" of base a and height b) at the same position in a corner of a putter head. The COM of the triangle is at x=a/3, y=b/3, and the COM of the rectangle is at x=a/2, y=b/2. The MOI ratios about the COMB are given by the following equations:

$$I_{T0}/W=(a^2-b^2)/18,$$

$$I_{R0}/W=(a^2-b^2)/12.$$

The rectangular MOI ratio is larger, but it will be shown that this difference is more than made up for by the fact that the triangle is further from the COM of the putter head.

Relevant distances are indicated in FIG. 4(*e*), where d=√(a^2+b^2)/3 denotes the distance between the origin and COM of the triangle and D denotes the distance between the outer corner of the rectangle and the COM of the putter head. The MOI ratio of the rectangle head about the COM of the putter head is, therefore given by the following equation:

$$I_R/W=I_R/W+(D+3d/2)^2=3d^2/4+(D+3d/2)^2$$

and the MOI ratio of the triangle about the COM of the putter head is given by the following equation:

$$I_T/W=I_{T0}/W+(D+2d)^2=d^2/2+(D+2d)^2$$

The difference is given by the following equation:

$$I_T/W-I_R/W=Dd+3\ d^2/2,$$

which is always positive. The above proves that the MOI ratio of the triangular load is always greater than the MOI ratio for the rectangular load.

In proving this result, a specific geometrical relationship between the loads and the COM of the putter head is chosen in FIG. 4(*e*), but the result is completely general. For any realistic geometry, the MOI difference is always positive and close to the value given above.

It can also be confirmed that the "vertical" rectangular connector of FIG. 4(*c*) achieves a larger MOI ratio about the putter head COM than the "horizontal" rectangular connector of FIG. 4(*d*) of the same dimension a×b×c and weight W. With reference to FIG. 4, the following equation is given for the vertical connector:

$$I_c/W=a^2/3+c^2/12+I^2-al,$$

and the following equation is given for the horizontal connector:

$$I_d/W=b^2/3+c^2/12+I^2-bl.$$

The difference is given by the following equation:

$$(I_c-I_d)/W=(b-a)(1-a/3-b/3).$$

For all parameter values of interest (0.125"≤a≤0.25", 0.5"≤b≤1", 1≥2"), this difference is positive and so the "vertical" rectangular connector of FIG. 4(*c*) is seen to provide the larger MOI ratio.

In a preferred embodiment, the load is chosen to be triangular with base dimensions a and b chosen to be between 0.25" and 1", depending on the chosen density and desired weight. The height dimension is chosen to be between about 1" and 2.5" (the maximum allowed by USGA regulations), depending on the load density, desired weight, and optimization specifications. As a novel contribution, in order to achieve the largest possible MOI ratios, load heights close to the 2.5" limit can be chosen. To insure overall stability of the putter head, the short length a of the connecting elements is chosen to be preferably at least 0.125", and the long height b is chosen to be preferably about 1".

For simplicity and economy, the face plate can be chosen to coincide with the connecting element between the forward loads. This choice also serves to minimize the consequent decrease of the overall value of I/W. The height of this element should be at least 1" in order to avoid ball miss-hits in the vertical direction. The length of the face plate must be long enough to connect the forward loads and, to comply with USGA regulations, at least ⅔ of the overall length. The thickness (width) should be at least 0.125", to provide a solid impact (momentum transformation) between the club and the ball.

It will now be demonstrated how to combine the three putter head elements into a complete entity with as large a MOI ratio $I/Wa^2$ as possible. As much of the weight as possible is placed as far as possible from the putter head's COM. This construction is constrained by USGA size regulations and a desire for a pleasant and manageable appearance. The specific configurations that will by described are preferred embodiments, which incorporate these principles and which, when using the optimal weight ratios derived hereinafter, give rise to optimally large MOI ratios. Skilled persons in the art can use similar components and optimization calculations to arrive at other configurations with very large MOI ratios.

A four-load putter head is initially described. For a given overall weight W and size a, this configuration gives rise to the absolute largest MOI value, a value as close as possible to the theoretical limit $I=Wa^2/2$. The basic configuration of a putter head 60 is illustrated in FIG. 5(*a*). The overall length is labeled a0 and the overall width is labeled b0. USGA regulations require that b0<a0, so that the optimal choice is b0=a0.

Four triangular loads 62, 64, 66, and 68 are situated at the four corners of the base rectangle. The lengths of the triangles are c1 (for the front loads 66 and 68) and d1 (for the back loads 62 and 64). The widths are c2 and d2 and the heights (coming out of the page as viewed in FIG. 5(*a*)) are c3 for the front loads 66 and 68 and d3 for the back loads 62 and 64. A faceplate 70, which also serves as the forward connecting element, is a rectangle of length a1=a0−2c1, width (thickness) is a2, and the height (coming out of the page as viewed in FIG. 5(*a*)) is a3. Left and right connecting elements 72 and 74 are rectangles of length b1, width b2=b0−c2−d2, and height b3 (coming out of the page as viewed in FIG. 5(*a*)). Apart from the shaft holder (not shown in FIG. 5(*c*)), which can be attached at any desired location, this minimal configuration is all that is needed.

This configuration achieves the goals of locating the relatively heavy loads 62, 64, 66, and 68 as far from the COM of the putter head 60 as possible, and locating the relatively light connecting elements 70, 72, and 74 as far from the COM as possible, given the constraint that they must hold the loads 62, 64, 66, and 68 and the faceplate 70 in place.

The final steps in the construction specifications, which will be carried out hereinafter, will be to choose values for the free parameters (a0, b1, c1, etc.). These choices are determined by the following four conditions: (1) the connecting elements 70, 72, and 74 are vertically oriented, as in FIG. 4(*c*), in order to maximize their contribution to the overall MOI; (2) the various dimensions are chosen by the desired overall size of the putter head 60; (3) the base-areas of the loads 62, 64, 66, and 68 are as small as practical, and their heights are as large as practical, in order to maximize their contribution to the overall MOI; and, (4) the relative weights of the front loads 66 and 68 and the back loads 62 and 64 are chosen by an optimization calculation to maximize the final overall MOI.

A three-load putter head 80 is shown in FIG. 5(*b*), and has one central front load 82 and two back loads 84 and 86. The triangular corners could be eliminated, constructed out of low-density material, or replaced by curved sections so as to create a U-shaped connection. However, this design necessarily gives rise to a putter head with a lower MOI ratio than the four-load head. The three-load putter head 80 is a T-shaped design. The faceplate is incorporated into the central forward load 82, and the rear triangular loads 84 and 86 are situated at the two rear corners of the base. This design is novel. Previously described three-load heads have the face situated at the other end of the base (the top of the T). The three-load putter head 80, while achieving an MOI ratio not quite as large as the four-load head 60, has the advantage of a more compact forward shape and, with the forward load incorporated into the faceplate, provides a more solid impact.

The dimensions of the various components of the three-load putter head 80 are given as the overall length a0 and the overall width b0. Optimally, b0=a0 as before. The length of each of the back loads 84 and 86 is d1, the width of each of the back loads 84 and 86 is d2, and the height of each of the back loads 84 and 86 (coming out of the page as viewed in FIG. 5(*b*)) is d3. The faceplate, which also serves as the front load 82, is a triangle of length a1≥2b2/3, width a2, and height a3 (coming out of the page as viewed in FIG. 5(*b*)). A back connecting element 88 is a rectangle of length c1=a0−2d1, width c2, and height c3 (coming out of the page as viewed in FIG. 5(*b*)). A central connecting element 90 is a rectangle of length b1, width b2=b0−c2−a2, and height b3 (coming out of the page as viewed in FIG. 5(*b*)). Apart from the shaft holder, which can be attached at any desired location, this minimal configuration is all that is needed.

This configuration has achieved the goals of locating the relatively heavy loads as far from the COM as possible, and the relatively light connecting elements as far from the COM as possible given the constraints of the desired geometry. The final step in the construction specifications, which is carried out hereinafter, is to choose values for the free parameters (a0, b1, c1, etc.). This choice is determined by the following four conditions: (1) the back connecting element 88 is vertically oriented, as in FIG. 4(*c*), and the central connecting element 90 is horizontally oriented, as in FIG. 4(*d*), in order to maximize their contributions to the overall MOI; (2) the various component dimensions are chosen by the desired overall size of the putter head 80; (3) the base-areas of the loads 82, 84, and 86 are as small as practical, and their heights are as large as practical; and, (4) the relative weights of the front and back loads 82, 84, and 86 are chosen by an optimization calculation.

A two-load putter head 100 is illustrated in FIG. 5(*c*). The putter head 100 is basically two-thirds of the four weight head shown in FIG. 5(*a*), and the same length labels can be used. The two-load putter head 100 has dense triangular loads 102 and 104, which are positioned at the upper right and lower left corners, and lighter connecting elements 106 and 108, which are solid rectangular boxes as before. The lower connecting element 108 comprises the faceplate of the two-load putter head 100, and a light lower right triangular element 110 provides structural support. This light triangular element 110 is a convenient place to insert the shaft, as indicated by the circular hole. Other possible two-load configurations are discussed below.

With regard to the theoretical limit (point loads and weightless connections), the two-load putter head 100 has the same MOI ($Wa^2/2$) as the four-load putter head 60. However, the effects of using realistic load sizes and connector weights are mixed. On the one hand, the two-load putter head 100 is favored because it has one fewer connecting element (two instead of three), but on the other hand, the four-load putter head 60 is favored because, for a given total weight, the loads 62, 64, 66, and 68 can be smaller than the loads 102 and 104 and, therefore, farther from the COM. The first effect increases I/W for the two-load putter head 100, and the second effect increases I/W for the four-load putter head 60. It turns out that the second effect dominates and so the realistic four-load head 60 has the (slightly) larger MOI ratio.

The final steps in the construction of the two-load head, which will be carried out hereinafter, is to choose values for the free parameters (a0, b1, c1, etc.). This choice is determined by the following four conditions: (1) the connecting elements 106 and 108 are vertically oriented, as in FIG. 4(*c*), in order to maximize their contributions to the overall MOI; (2) the various component dimensions are chosen by the desired overall size of the head; (3) the base-areas of the loads 102 and 104 are made as small as practical, and their heights are made as large as practical; and, (4) the relative weights of the front and back loads 104 and 102 are chosen by an optimization calculation to maximize the final overall MOI.

Figure 6A:
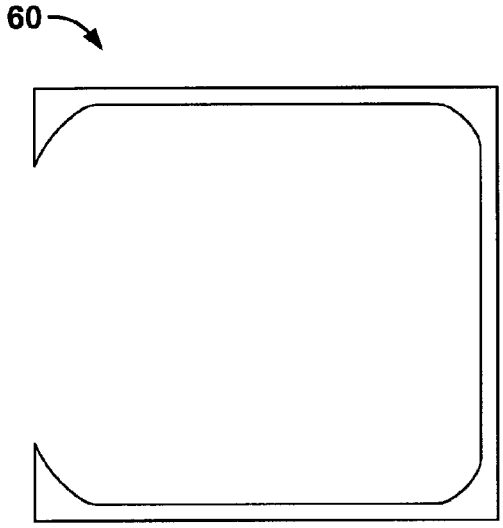
FIG. 6 illustrates smoothed version of four-load and three-load putter heads of FIG. 5.
Figure 6B:
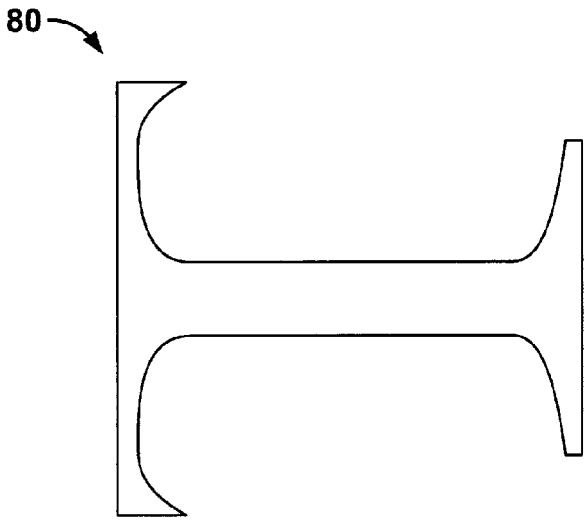
Figure 6C:
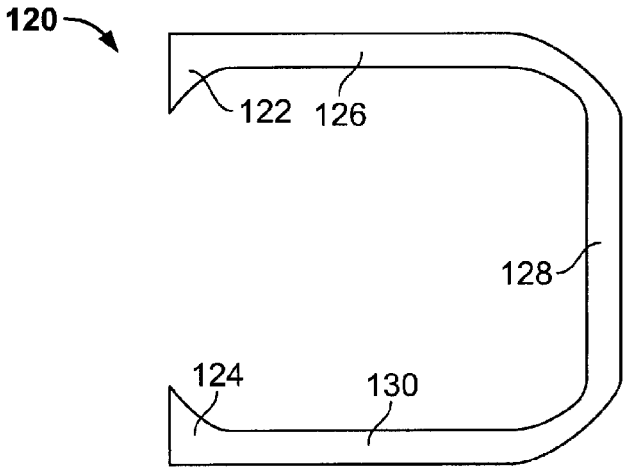
Figure 7A:
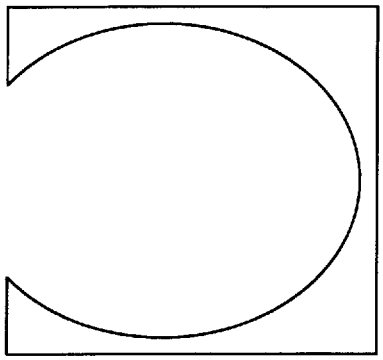
FIG. 7 illustrates other four-load and three-load putter heads.
Figure 7B:
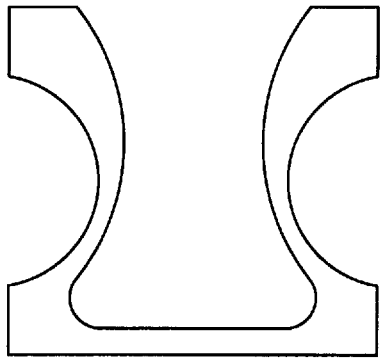
Figure 7C:
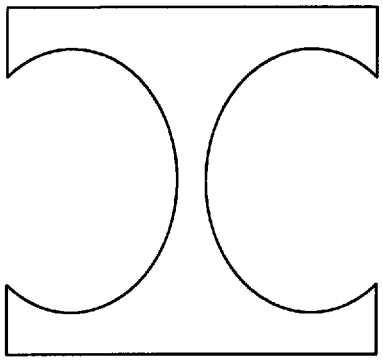
Figure 7D:
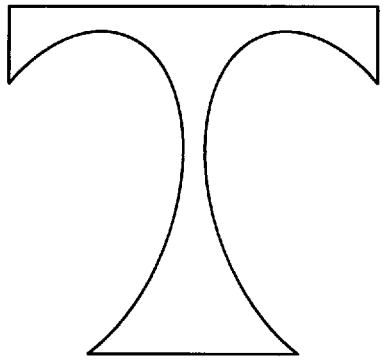
Figure 7E:
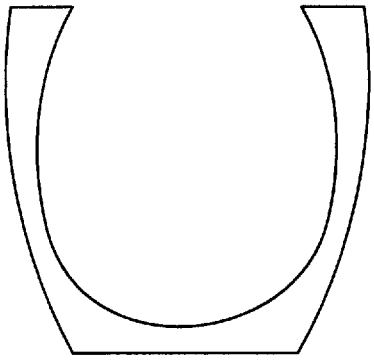
Figure 7F:
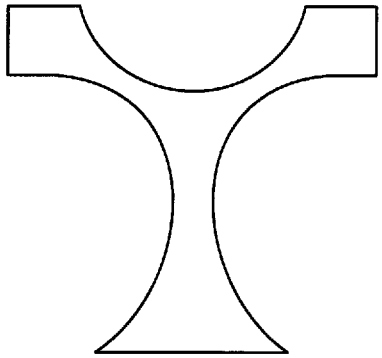
Figure 8A:
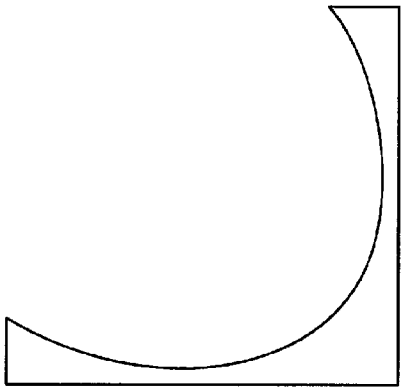
FIG. 8 illustrate two-load putter heads.
Figure 8B:
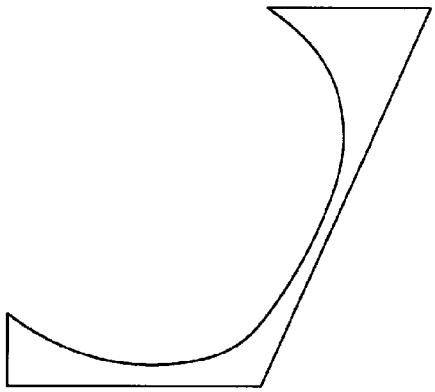
Figure 8C:
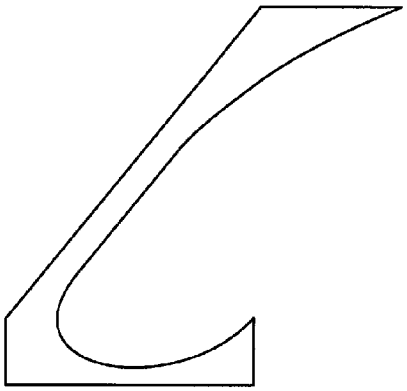
Figure 8D:
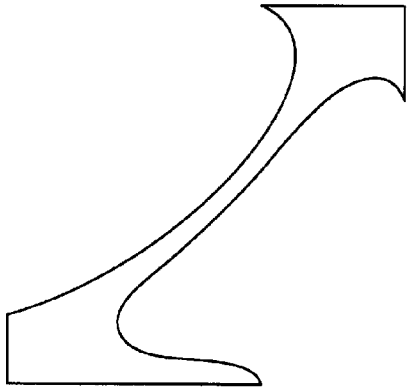
Figure 8E:
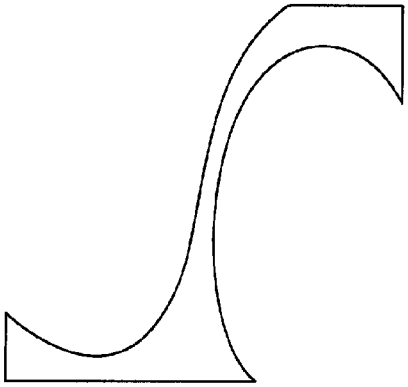
Figure 8F:
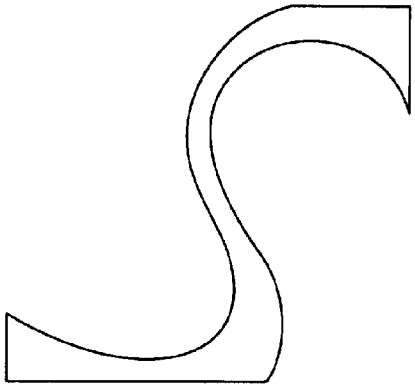

The putter head configurations illustrated in FIG. 5 consist of simple combinations of the most basic triangular loads and rectangular connectors. In order to achieve a better-looking and more marketable appearance, these configurations can be smoothed out without significantly decreasing their MOI ratios. FIG. 6 illustrates some of the many possibilities. A smoothed version of the four-load putter head 60 is illustrated in FIG. 6(*a*), and a smoothed version of the three-load putter head 80 is illustrated in FIG. 6(*b*). A different version of a two-load putter head 120 is illustrated in FIG. 6(*c*). The two-load putter head 120 has loads 122 and 124 interconnected by connecting elements 126, 128, and 130. Because the connecting elements 126, 128, and 130 are farther from the COM, the two-load putter head 120 has a larger MOI ratio than the three-load putter head 80, but is not as compact, and it has a smaller MOI ratio than the four-load putter head 60. A smoothed version of the two-load head 100 looks like the smoothed version of the four-load putter head 60 without the lower arm.

Figure 9A:
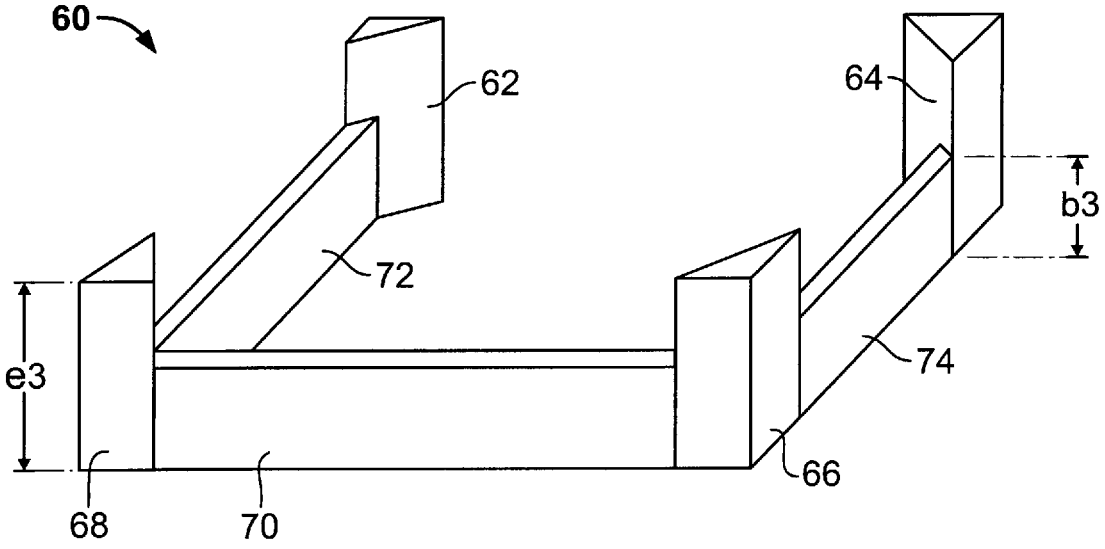
FIG. 9 is a three-dimensional illustration of a four-load putter head.
Figure 9B:
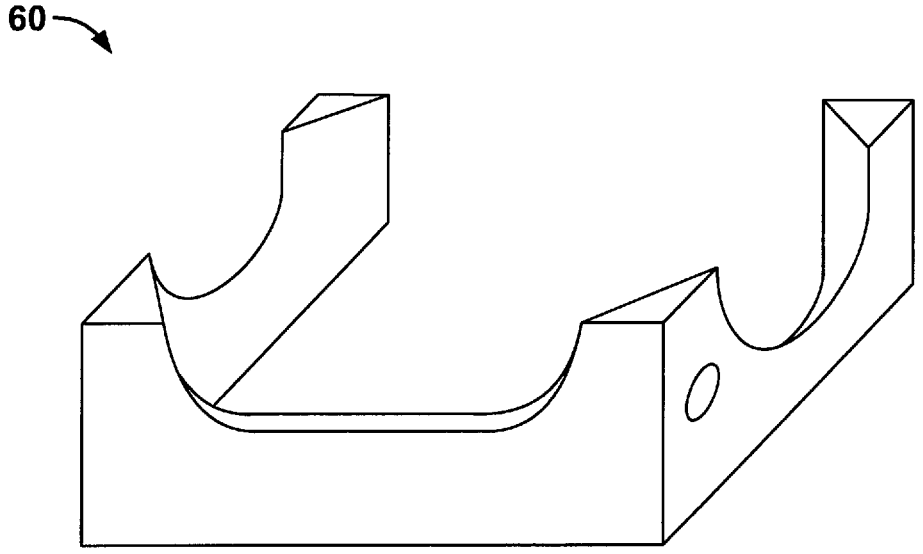

Some other possibilities for four-load putter heads are illustrated in FIGS. 7(*a*), 7(*b*), and 7(*c*), some other possibilities for three-load putter heads are illustrated in FIGS. 7(*d*), 7(*e*), and 7(*f*), and some other possibilities for two-load putter heads are illustrated in FIGS. 8(*a*)-(*f*). A three-dimensional illustration of the four-load putter head 60 is provided by FIG. 9(*a*), and an illustration of a smoothed version of this putter head is provided by FIG. 9(*b*).

For a given configuration, the MOI I depends on the dimensions and densities of the included components. For simplicity, it is assumed here that each putter head uses only two different densities, the density dh of the heavy load elements and the density dl of the light connecting elements. The MOI ratio I/W is then a function of the density ratio r=dh/dl. A possible material for the light connecting elements is aluminum, with a weight density dl of about 1.6 oz/in$^3$. Possible materials for the heavy load elements include copper (dh=5.3 oz/in$^3$), lead (dh=6.7 oz/in$^3$), and tungsten (dh=11.4 oz/in$^3$). The resulting density ratios are r=3.3, 4.2, and 7.1. The choice of r depends on the desired weight, size, and MOI of the putter head.

The first step in optimizing a putter head is to choose its optimization parameter(s). Possible choices for these parameters include the ratio(s) of the load weight, sizes, or densities. For illustrative purposes, a single parameter s, a size ratio of the forward and backward load elements, is used.

The second step is to choose the component dimensions not determined by the optimization variable s. These dimensions are restricted by the desired size, weight, and MOI of the putter head. Each choice influences the optimal value s1 of s, and some dimension values must be adjusted in order to achieve a desired weight and MOI.

The third step is to express the COM (x(s),y(s)), total weight W(s), MOI I(s), and ratio f(s)=I(s)/W(s) as functions of s. The optimal value s1 of s can then be determined by finding the appropriate solution of the following differential equation:

$$df(s)/ds=f'(s)=0.$$

This procedure determines the optimal values of the COM (x1,y1), weight W1, MOI I1, and ratio f1=f(s1) for the chosen densities and dimensions.

If the resultant weight is not acceptable, then some of the dimensions and/or densities can be adjusted, and the optimization calculation repeated, to achieve the desired weight. Alternatively, a weight condition, W(s)=constant, can be solved simultaneously with f'(s)=0.

As a first example of the above optimization procedure and resultant MOI values, the four-load putter head 60 is considered. The overall dimensions of the base rectangle are ab0=a0=b0. The heal-toe dimensions are a1, b1, etc., the front-back dimensions are a2, b2, etc., and the vertical dimensions are a3, b3, etc. The thickness of the connecting elements 70, 72, and 74 are chosen to be a2=b1=⅛"=0.125", and their heights to be a3=b3=1". The parameter ab0 is varied between 4" and 7" (the maximum allowed by the USGA) and the load/connector density ratio r is varied between 3 (e.g., copper/aluminum) and 7 (e.g., tungsten/aluminum). The optimization variable s=c3/d3 is chosen. This ratio is the ratio of the front and back load heights. The back load height d3 is chosen between 1" and 2.5" (the maximum allowed by the USGA). The load base dimensions (cd12=c1=c2=d1=d2) are chosen between 0.5" and 1" to keep the total weight between 11 oz and 17 oz.

The results of the optimization calculations for some of these choices relative to a four-load putter head are given in Table 1.

TABLE 1

| ab0 | r | cd12 | d3 | s1 | c3 | y1 | I/W | I/Wa$^2$ | I | W | wd |
|---|---|---|---|---|---|---|---|---|---|---|---|
| 7 | 3 | 1 | 1 | 0.986 | 0.99 | 3.24 | 18.6 | 0.380 | 233 | 12.5 | 4.6 |
| 7 | 3 | 0.813 | 1.5 | 1.182 | 1.77 | 3.18 | 19.05 | 0.389 | 238 | 12.5 | 4.6 |
| 7 | 3 | 0.625 | 1.5 | 1.014 | 2.43 | 3.17 | 19.63 | 0.401 | 239 | 12.2 | 4.4 |
| 7 | 5 | 1 | 1 | 0.988 | 0.99 | 3.33 | 19.14 | 0.391 | 352 | 18.4 | 7.8 |
| 7 | 5 | 0.625 | 1.5 | 1.013 | 1.52 | 3.19 | 19.70 | 0.402 | 248 | 12.6 | 4.6 |
| 7 | 5 | 0.5 | 2 | 1.031 | 2.06 | 3.11 | 19.82 | 0.404 | 226 | 11.4 | 3.9 |
| 7 | 5 | 0.5 | 2.4 | 1.021 | 2.45 | 3.16 | 20.13 | 0.411 | 262 | 13.0 | 4.7 |
| 7 | 7 | 0.5 | 1.5 | 1.028 | 1.54 | 3.13 | 19.90 | 0.406 | 235 | 11.8 | 4.1 |
| 7 | 7 | 0.5 | 2 | 1.015 | 2.03 | 3.20 | 20.36 | 0.416 | 295 | 14.5 | 5.5 |
| 7 | 7 | 0.5 | 2.4 | 1.010 | 2.42 | 3.25 | 20.62 | 0.421 | 344 | 16.7 | 6.6 |
| 6 | 3 | 1 | 1.5 | 0.981 | 0.98 | 2.82 | 13.42 | 0.373 | 156 | 11.6 | 4.7 |
| 6 | 3 | 1 | 2 | 0.985 | 1.48 | 2.88 | 13.69 | 0.380 | 223 | 16.3 | 7.0 |
| 6 | 3 | 0.625 | 2.4 | 1.006 | 2.41 | 2.76 | 14.34 | 0.398 | 166 | 11.6 | 4.4 |
| 6 | 5 | 1 | 1 | 0.986 | 0.99 | 2.89 | 13.75 | 0.382 | 245 | 17.8 | 7.8 |
| 6 | 5 | 0.625 | 1.5 | 1.005 | 1.51 | 2.77 | 14.38 | 0.399 | 171 | 11.9 | 4.6 |
| 6 | 5 | 0.5 | 2 | 1.020 | 2.04 | 2.71 | 14.55 | 0.404 | 157 | 10.8 | 3.9 |
| 6 | 5 | 0.5 | 2.4 | 1.013 | 2.43 | 2.75 | 14.75 | 0.410 | 181 | 12.3 | 4.7 |
| 6 | 7 | 0.5 | 1.5 | 1.018 | 1.53 | 2.73 | 14.60 | 0.406 | 164 | 11.2 | 4.1 |
| 6 | 7 | 0.5 | 2 | 1.009 | 2.02 | 2.78 | 14.91 | 0.414 | 207 | 13.9 | 5.5 |
| 6 | 7 | 0.5 | 2.4 | 1.005 | 2.41 | 2.82 | 15.07 | 0.419 | 243 | 16.1 | 6.6 |
| 5 | 7 | 0.5 | 2.4 | 1.002 | 2.40 | 2.38 | 10.35 | 0.414 | 160 | 15.5 | 6.6 |
| 4 | 7 | 0.5 | 2.5 | 0.999 | 2.50 | 1.93 | 6.49 | 0.406 | 100 | 15.4 | 6.8 |

In the first row of data, the overall head base dimension is 7"×7" and the density ratio is r=3. The load triangles have 1"×1" bases and the height of the back loads is also 1". The optimization calculation gives s1=0.986 so that the front loads are also 1" high (c3=s1*d3=0.99"). The COM location in the toe-heal direction is x1=3.5" since the four-load putter heads are left-right symmetric. The COM location in the front-back direction is y1=3.24". The value 18.6 in$^2$ for I/W is already much larger than for any previously disclosed putter head, and quite close to the theoretical limit of 24.5 in$^2$ for a 7" head. Likewise, the value 0.38 for I/Wa$^2$ is extremely large and close to its theoretical limit of 0.50. The head weight is W=12.5 oz, but this weight can be adjusted to any desired value without changing I/W.

The value of I/W can be further increased by choosing the bases of the loads to be smaller. This places the COM of the loads farther from the head COM, and therefore increases the MOI. This can be accomplished in two ways: the load heights d3 and c3 and/or the load densities r can be increased. The effect of increasing d3 is shown in the next two rows in Table 1. Increasing d3 to 1.5" and decreasing cd12 to 13/16" increases I/W to 19.1 $in^2$ without changing the head weight. Increasing d3 to the USGA limit of 2.5" in not acceptable because the corresponding optimal choice for c3 would be greater than the 2.5" limit, but setting d3=2.4", with cd12=⅝"=0.625", gives the compliant value c3=2.43", and increases I/W to 19.6 $in^2$.

The effect of increasing r is shown in the next rows in Table 1. Increasing r to 5 and then to 7, while decreasing cd12 to maintain reasonable weights W, increases the MOI ratio for each choice of d3. When both r and d3 are increased, the MOI ratio increases even further. The largest value for I/W is 20.6 $in^2$, obtained for the largest density ratio r=7 and largest load height d3=2.4".

Considered next is the optimization calculations and MOI evaluations for the two-load putter heads. The two-load configurations have fewer connecting elements, which tends to increase I/W, but, for a given total weight, the loads must be larger, because there are fewer of them, and this tends to decrease I/W. It will be seen that this latter effect dominates, and so, for a given size and weight, I/W is less than it is for the four-load configurations.

The two-load configuration is illustrated in FIG. 5(*c*), with the same notation as that of the four-load configuration. The fixed dimensions are chosen to be a2=b1=⅛" and a3=b3=1" as above, and now also c1=c2=⅝". I choose the optimization parameter to be s=c3/d3 as above. The results of the optimization calculations, for various values of ab0, r, d12, and d3, are given in Table 2 below. Both COM coordinates (x1,y1) are now given because the head is no longer left-right symmetric. The I/W values are seen to be between 3% and 4.5% less than those of the four-load heads. The largest chosen values for d3 are limited by the requirement that c3 is less than the USGA limit of 2.5".

TABLE 2

| ab0 | r | cd12 | d3 | s1 | c3 | x1 | y1 | I/W | I/Wa$^2$ | I | W | wd |
|---|---|---|---|---|---|---|---|---|---|---|---|---|
| 7 | 3 | 1 | 1 | 1.484 | 1.48 | 2.31 | 3.12 | 17.70 | 0.361 | 158 | 8.9 | 4.7 |
| 7 | 3 | 1 | 1.5 | 1.307 | 1.96 | 2.50 | 3.09 | 18.21 | 0.372 | 211 | 11.6 | 7.0 |
| 7 | 3 | 1 | 1.5 | 1.219 | 2.44 | 2.61 | 3.07 | 18.51 | 0.378 | 263 | 14.2 | 9.4 |
| 7 | 7 | 1 | 1 | 1.227 | 1.23 | 2.82 | 3.34 | 19.06 | 0.389 | 288 | 15.1 | 10.9 |
| 7 | 7 | 0.625 | 1.5 | 1.445 | 2.17 | 2.50 | 3.38 | 19.73 | 0.403 | 211 | 10.7 | 6.4 |
| 7 | 7 | 0.5 | 2 | 1.370 | 2.47 | 2.59 | 2.47 | 19.96 | 0.407 | 242 | 12.1 | 7.7 |
| 6 | 7 | 0.75 | 2.1 | 1.171 | 2.46 | 2.49 | 2.85 | 14.50 | 0.403 | 244 | 16.8 | 12.9 |
| 6 | 7 | 0.625 | 1.9 | 1.289 | 2.45 | 2.32 | 2.87 | 14.57 | 0.405 | 173 | 11.9 | 8.1 |
| 5 | 7 | 0.75 | 2.2 | 1.126 | 2.48 | 2.14 | 2.37 | 9.82 | 0.393 | 165 | 16.8 | 13.5 |
| 5 | 7 | 0.625 | 2 | 1.217 | 2.43 | 2.02 | 2.38 | 9.97 | 0.399 | 117 | 11.7 | 8.5 |
| 4 | 7 | 0.75 | 2.3 | 1.085 | 2.50 | 1.77 | 1.89 | 6.02 | 0.376 | 101 | 16.8 | 14.1 |
| 4 | 7 | 0.625 | 2.1 | 1.151 | 2.42 | 1.69 | 1.90 | 6.20 | 0.388 | 71 | 11.4 | 9.0 |

This very large I/W value can be further increased by fine-tuning the various load and connector dimensions. Val ues over 21 $in^2$ are easily attainable, corresponding to I/Wa$^2$ values over 0.43. MOI values even close to these have never been previously attained. The 7"×7"×2.5" putter head size is, of course, while USGA compliant, larger than desirable for most golfers. The methods described here will, however, yield the largest possible MOI ratios for any desired putter head size. This is illustrated in the remaining rows of Table 1.

It can be seen in the table that as ab0 is decreased to 6", 5", or 4", the maximum values of I/W (obtained for r=7 and d3=2.4"–2.5") decrease to 15.1, 10.4, and 6.5 $in^2$, respectively, with I/Wa$^2$ decreasing from 4.2 to 4.1. These values are more all than three times those larger than those previously disclosed for putter heads of the same size.

The three-load putter head configurations are considered next. Described above are two distinct types: the U-type, illustrated in FIG. 5(*d*), and the T-type, illustrated in FIG. 5(*b*). First considered is the U-type putter head. The fixed dimensions are a2=b1=⅛" and a3=b3=1" as before, and also the thickness of the forward load will be fixed at e2=⅛". The optimization parameter is chosen to be s=e2/d2, the front/back load width ratio. The results of the optimization calculations, for ab0=7, 6, 5, and 4, r=3 and 7, e3=1 and 0.5, and d3=1 and 2.5 are given in Table 3. The back load base size d1=d2=d12 is adjusted to give reasonable weights. The I/W values are seen to be between 13% and 15% less than those of the four-load heads, but still much larger than those described in the prior art.

TABLE 3

| ab0 | r | cd12 | d12 | d3 | s1 | e1 | y1 | I/W | I/Wa$^2$ | I | W | wd |
|---|---|---|---|---|---|---|---|---|---|---|---|---|
| 7 | 3 | 1 | 1 | 1 | 0.706 | 0.71 | 4.54 | 16.92 | 0.345 | 142.1 | 8.4 | 4.7 |
| 7 | 7 | 1 | 1 | 1 | 4.070 | 4.07 | 3.90 | 17.01 | 0.347 | 343.6 | 20.2 | 10.9 |
| 7 | 7 | 0.5 | 0.75 | 1 | 4.543 | 3.41 | 4.00 | 17.46 | 0.356 | 214.8 | 12.3 | 6.1 |
| 7 | 7 | 0.5 | 0.5 | 2.5 | 7.024 | 3.51 | 4.15 | 17.96 | 0.367 | 235.3 | 13.1 | 6.8 |
| 6 | 7 | 0.5 | 0.5 | 1 | 10.73 | 5.36 | 2.28 | 11.94 | 0.332 | 115.8 | 9.7 | 2.7 |
| 6 | 7 | 0.5 | 0.5 | 2.5 | 6.070 | 3.04 | 3.68 | 13.01 | 0.361 | 158.7 | 12.2 | 6.8 |
| 5 | 7 | 0.5 | 0.5 | 1 | 8.516 | 4.26 | 2.08 | 8.44 | 0.338 | 70.9 | 8.4 | 2.7 |
| 5 | 7 | 0.5 | 0.5 | 2.5 | 5.057 | 2.53 | 3.20 | 8.80 | 0.352 | 99.44 | 11.3 | 6.8 |
| 4 | 7 | 0.5 | 0.75 | 1 | 2.584 | 1.94 | 2.57 | 5.15 | 0.322 | 48.93 | 9.5 | 6.1 |
| 4 | 7 | 0.5 | 0.5 | 2.5 | 3.968 | 1.98 | 2.69 | 5.37 | 0.336 | 55.31 | 10.3 | 6.8 |
| 4 | 7 | 1 | 0.5 | 2.5 | 4.645 | 2.32 | 2.31 | 5.55 | 0.347 | 67.16 | 12.1 | 6.8 |

The final example is the T-type three-load configuration. The fixed dimensions are chosen as above: a3=b1=c3=1" and b3=c2=⅛". The head size ab0 varies from 4" to 7", the density ratio r is 3 or 7, and the back load height is 1" or 2.5". The front face al of the front load is chosen to have length 2a0/3, the smallest face length compliant with USGA regulations. I have chosen this length to be as small as possible because the main advantage of this configuration over the above ones is its more compact size. The optimization parameter is again chosen to be s=a2/d2, the front/back load width ratio. The back load base size d12 is again adjusted to give reasonable weights. The results of the optimization calculations are given in Table 4.

TABLE 4

| ab0 | r | a1 | d12 | d3 | s1 | a2 | y1 | I/W | I/Wa$^2$ | I | W | wd |
|---|---|---|---|---|---|---|---|---|---|---|---|---|
| 7 | 3 | 4.7 | 1 | 1 | 0.380 | 0.38 | 3.97 | 14.73 | 0.301 | 170.9 | 11.6 | 4.7 |
| 7 | 3 | 4.7 | 0.63 | 1 | 0.590 | 0.37 | 4.03 | 15.27 | 0.312 | 174.1 | 11.4 | 4.6 |
| 7 | 7 | 4.7 | 1 | 1 | 0.312 | 0.31 | 4.06 | 15.73 | 0.321 | 341.3 | 21.7 | 10.9 |
| 7 | 7 | 4.7 | 0.75 | 1 | 0.272 | 0.20 | 3.97 | 15.66 | 0.320 | 220.8 | 14.1 | 6.1 |
| 7 | 7 | 4.7 | 0.5 | 2.5 | 0.433 | 0.22 | 4.05 | 16.21 | 0.331 | 244.8 | 15.1 | 6.8 |
| 6 | 7 | 4 | 0.75 | 1 | 0.303 | 0.23 | 3.43 | 11.44 | 0.318 | 153.3 | 13.4 | 6.1 |
| 6 | 7 | 4 | 0.5 | 2.5 | 0.483 | 0.24 | 3.51 | 11.89 | 0.330 | 171.2 | 14.4 | 6.8 |
| 5 | 7 | 3.4 | 0.75 | 1 | 0.337 | 0.25 | 2.88 | 7.85 | 0.314 | 100.5 | 12.8 | 6.1 |
| 5 | 7 | 3.4 | 0.5 | 2.5 | 0.536 | 0.27 | 2.96 | 8.21 | 0.328 | 113.3 | 13.8 | 6.8 |
| 4 | 7 | 2.7 | 0.75 | 1 | 0.392 | 0.29 | 2.33 | 4.88 | 0.305 | 58.56 | 12.0 | 6.1 |
| 4 | 7 | 2.7 | 0.5 | 2.5 | 0.623 | 0.31 | 2.41 | 5.15 | 0.322 | 66.95 | 13.0 | 6.8 |

The largest values of I/W are again correspond to the larger size of ab0 and the larger density ratio r. For a given size and density, the largest values correspond to the largest back load height d3. The I/W values are seen to be between 20% and 21% less than those of the four-load heads, but again still much larger than those previously described in the prior art.

Some of the above results are summarized is Table 5 that provides I/W values for the four lengths (7", 6", 5", and 4") of the four putter head types.

TABLE 5

| type/length | 7 | 6 | 5 | 4 |
|---|---|---|---|---|
| 4S | 20.6 | 15.1 | 10.4 | 6.5 |
| 2L | 20.0 | 14.6 | 10.0 | 6.2 |
| 3U | 18.0 | 13.0 | 8.8 | 5.6 |
| 3T | 16.2 | 11.9 | 8.2 | 5.2 |

This table exhibits the maximum obtained value of the MOI ratio I/W (in in$^2$ units) for various head lengths (4", 5", 6", and 7") and for the four head types (4 load square-type 4S, 2 load L-type 2L, 3 load U-type 3U, and 3 load T-type 3T). For each head type, the I/W values decrease as the head size a decreases, and for each head size, the I/W value is largest for the 4 load square-configuration and smallest for the 3 load T-configuration. The decreases in I/W with size are much larger than the decreases in I/W with putter head type. For all sizes and types, the obtained I/W values are very much larger than those for all known prior art or marketed putters.

For each head type, the I/W values are approximately proportional to a$^2$, and so are approximately constant when a$^2$ is divided out. The I/Wa$^2$ values are given in Table 6 for these same putter head types and sizes. These values are seen to change by only a few percent for each head type.

TABLE 6

| I/Wa$^2$ vs. length for four head types | | | | |
|---|---|---|---|---|
| type/length | 7 | 6 | 5 | 4 |
| 4S | 0.421 | 0.419 | 0.414 | 0.406 |
| 2L | 0.407 | 0.405 | 0.399 | 0.388 |

TABLE 6-continued

| I/Wa$^2$ vs. length for four head types | | | | |
|---|---|---|---|---|
| type/length | 7 | 6 | 5 | 4 |
| 3U | 0.367 | 0.361 | 0.352 | 0.347 |
| 3T | 0.331 | 0.330 | 0.328 | 0.322 |

Figure 11:
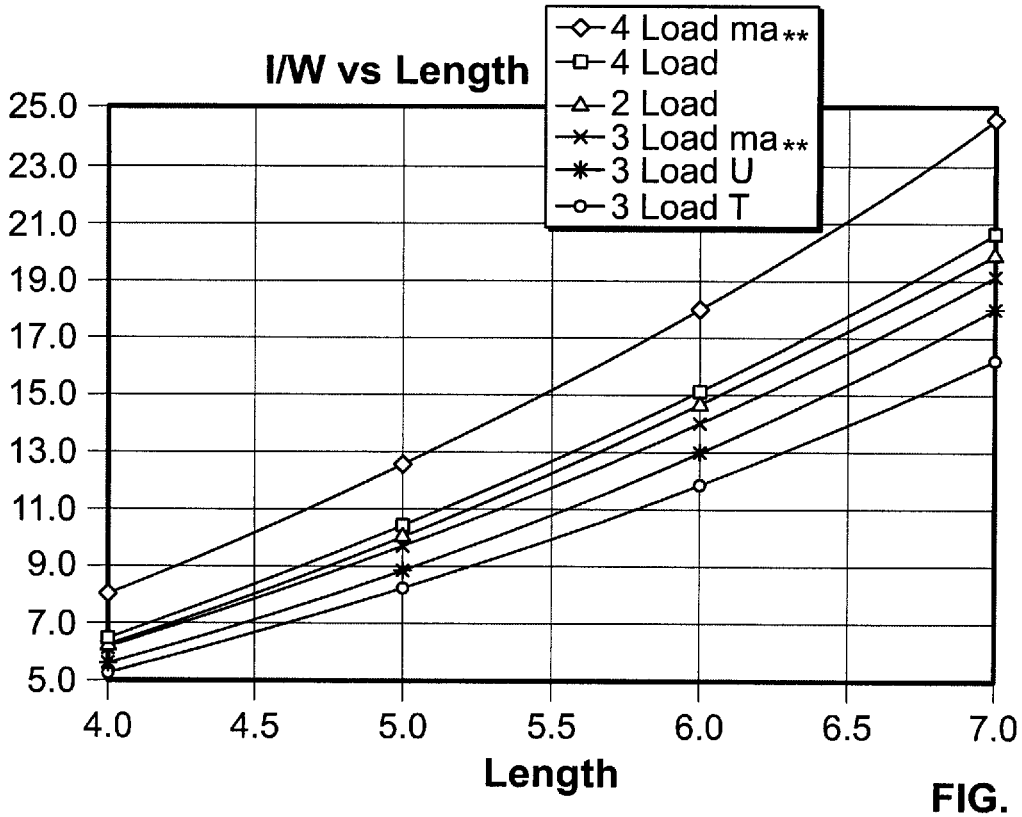
FIG. 11 is a graph of I/W vs. length for various putter head types.

The data in Table 5 are graphically illustrated in FIG. 11. The highest curve on the chart gives the I/W maximum possible values a2/2 for the theoretical 4-load head. The next two curves are for the 4-load and 2-load heads. The fourth curve gives the I/W maximum possible values 25*a*2/64 for the theoretical 3-load head, and the lowest two curves are for the 3U and 3T heads, respectively. The obtained values for each head type are as close as possible to the theoretical upper limits. The MOI ratios of prior art putter heads are not even close these obtained values.

The data exhibited in tables 1-6 and the graph of FIG. 11 enables each golfer to choose an ideal putter head size and type from among the configurations described in this document. The choices can be determined from the I/W verses size graph in FIG. 11. Each golfer can choose appropriate criterion in one of two ways. The golfer can state the largest head size with which the golfer is comfortable, or the golfer can state the smallest I/W value that the golfer finds necessary. The size criterion is based on the look and feel desired by the golfer, whereas the MOI criterion is based on the magnitude of the off-center error the golfer typically makes. The larger this error, the larger is the MOI needed to control the putt. The head weight W desired by the golfer determines the MOI ratio I/W appropriate for the golfer.

Figure 12:
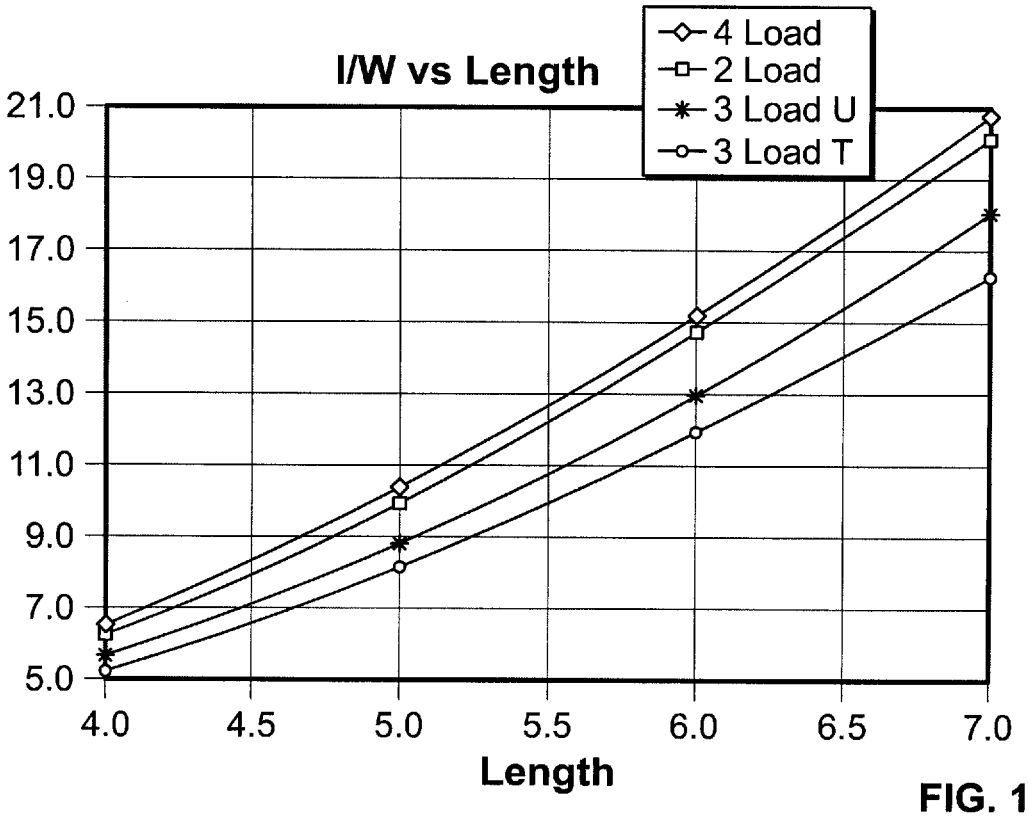
FIG. 12 is a graph similar to the graph of FIG. 11.

FIG. 12 is the same as FIG. 11 but with the theoretical 4-load putter head and 4-load putter head plots removed.

To illustrate the procedure, suppose that a given golfer desires a MOI ratio of 11 in$^2$ to control off-center hitting errors. The smallest length putter head that will provide this ratio is given by the intersection of the 11 in$^2$ horizontal line with the appropriate curve in FIG. 12. This golfer can thus use the 4-load type head with size a=5.1", the 2-load head with a=5.2", the 3-load U head with a=5.5", or the 3-load T head with a=5.8". The choice among these possibilities depends on the size and shape of the head with which the golfer is most comfortable.

Suppose instead that the golfer does not want to use a putter head with size a greater than 5.5". The available range of maximum MOI ratios for this golfer is given by the intersection of the 5.5" vertical line with the appropriate curve in FIG. 12. This golfer can thus use the 4-load head with I/W=12.5

$in^2$, the 2-load head with I/W=12.25 $in^2$, the 3-load U head with I/W=10.75 $in^2$, or the 3-load T head with I/W=9.75 $in^2$. The choice among these possibilities depends on the MOI ratio that the golfer needs to control off-center hitting errors.

Whatever a given golfer requires, the putter head described herein provides the golfer with the largest possible MOI. If the golfer's size requirement comes first, the golfer can use the vertical lines in FIG. 12, or the data in Table 5, to choose an appropriate MOI value. If the golfer's MOI requirement comes first, the golfer can use the horizontal lines in FIG. 12, or the data in Table 7 below, to choose an appropriate length value.

TABLE 7

| type/IW | 7 | 11 | 15 | 19 |
|---|---|---|---|---|
| 4S | 4.07 | 5.11 | 5.97 | 6.72 |
| 2L | 4.13 | 5.19 | 6.07 | 6.83 |
| 3U | 4.38 | 5.49 | 6.41 | >7 |
| 3T | 4.59 | 5.75 | 6.73 | >7 |

If, for example, a golfer requires I/W=7 $in^2$, the golfer can use the 4S putter head with a=4.1" or the 3T head with a=4.6", etc. If the golfer instead uses a conventional head, a size of 6" or 7" would be required. If the golfer requires I/W=11 $in^2$, the golfer can use the 4S putter head with a=5.1", or the 3T head with a=5.75", or etc. If the golfer instead wants to use a conventional head, the golfer would find nothing available. (No conventional head, of any USGA compliant size, can provide an MOI ratio as large as 11 $in^2$.) These considerations illustrate a major advantage of the heads disclosed herein. They provide the largest MOI for a given weight and size, or, equivalently, they provide the heads of the smallest size for a given weight and MOI.

The same goes for the larger I/W values. As an extreme case, if I/W=19 $in^2$ is required (for a golfer who hits off-center by several inches!), the head choices are limited to the 6.7" 4S head or the 6.8" 2L head. The 3-load heads require sizes beyond the USGA limit of 7", and conventional heads would require sizes of over 10".

These tables and graphs display data for putter heads of maximum MOI ratio for each head type. These maximum values of I/W arise from use of load heights at or close to the maxim value of 2.5" compliant with USGA regulations, and the use of load densities as large as practical. If one chooses to use lower load heights, the methods disclosed herein can be used to design heads with maximum MOI ratios for a given head length and load height.

The very large MOI ratios disclosed herein are achieved from use of the following disclosed principles: 1) because of their placement and shape, the head loads and connecting elements are located as far as possible from the head COM; 2) because of their dimensions and shapes, the head loads are as heavy as possible, and the connecting elements are as light as possible; and, 3) the load weight ratios are optimally determined by mathematical maximization calculations.

Figure 10:
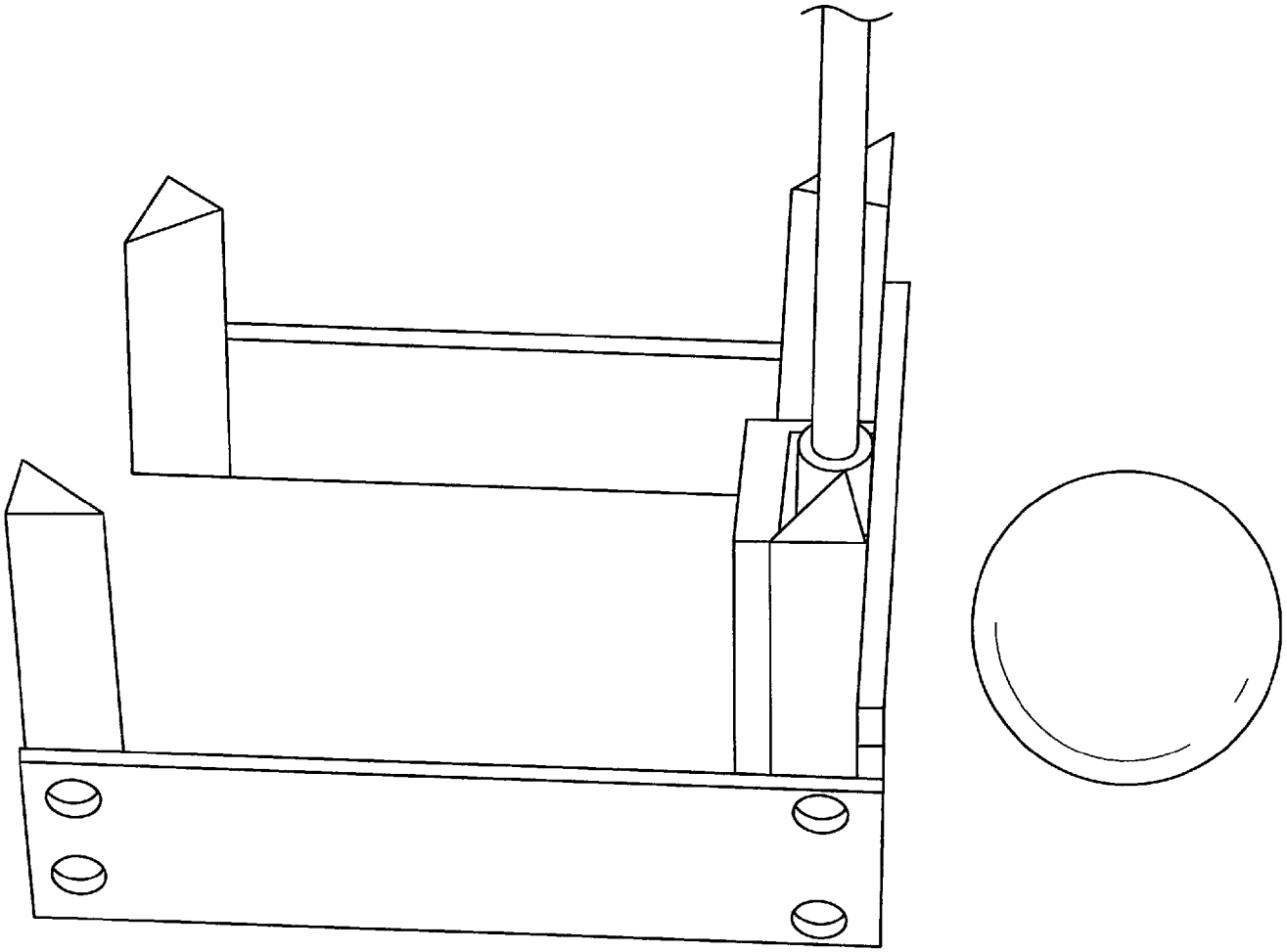
FIG. 10 is a three-dimensional illustration of a four-load putter head with shaft.

Embodiments of these principles as disclosed above are intended to illustrate these principles. Persons skilled in the art can easily use these principles to design large MOI putter heads with many different sizes, shapes, densities, and appearances. It is likewise easy to incorporate conventional elements such as a lofted face to help lift a golf ball, a face with ridges to provide more friction and spin, an embedded elastomer to provide better feel, a (possibly adjustable) shaft holder, and a visible line to indicate the COM position. (Because of the large MOI, the latter element is not really necessary.) A prototype four-load putter is shown in FIG. 10.

Structure Ratios for Large MOI Putters

1. The connecting elements have a relatively small density, such as 1.6 oz/$in^3$ (aluminum), and the load elements have a relatively large density, such as 5.3 oz/$in^3$ (copper) and 11.6 oz/$in^3$ (tungsten). The density ratios thus vary from 3.3 to 7.3.

2. The loads are much higher than wide, with heights preferably close to the USGA limit of 2.5" and widths between 0.5" and 0.75". The ratio of load height h to width d is at least 3 and preferably about 5.

3. The base of the head is preferably square (side length a), with the loads placed at the four corners for the four-load head, two opposite corners for the two-load head, and at the two rear corners and at the center of the front side for the three load head. The corner loads are preferably substantially right-triangular, with right sides of equal length d. The width d is preferably about 0.5", so that the ratio of base width a to load width d is about 8 for a=4" and 14 for a=7".

4. There are as few connecting elements as possible (three for the four-load and three-load heads, two for the two-load head), and they are placed at the perimeter of the head base. The connecting elements are much higher than wide, with heights about 1" and widths about ⅛" for stability. The ratio of connector height to width is thus at least about 8.

5. The total weight we of the (aluminum) connecting elements is about a*(0.6 oz/in), and the typical total head weight is about W=12 oz. The ratio wc/W is thus about a/20", which is 0.20 for a=4" and 0.35 for a=7".

6. The ratio s=w1/w2 of the front-load weight w1 to the back-load weight w2 is such that the MOI ratio $f(s)=I/Wa^2$ is maximal. That is, s is the appropriate solution of df/ds=0. This ratio is found to vary between 1.0 and 1.5, depending on the size and configuration of the club head.

Certain modifications of the present invention have been discussed above. Other modifications of the present invention will occur to those practicing in the art of the present invention. Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

What is claimed is:

1. A putter head for a putter comprising:
a toe;
a heel;
a front that strikes a ball;
a back opposite the front;
a length a between the heel and toe;
a width b between the front and back;
a weight W;
a moment of inertia I about a vertical axis of a center of mass of the putter head, wherein $I/Wa^2>0.30$; and
a plurality of loads interconnected by at least one connecting element,
wherein the loads have a load density,
wherein the connecting element has a connecting element density, and
wherein a ratio of the load density to the connecting element density is in the range of 3 to 8.

2. The putter head of claim 1, wherein $0.30<I/Wa^2\leq 0.50$.

3. A putter head for a putter comprising:
a toe;
a heel;
a front that strikes a ball;
a back opposite the front;
a length a between the heel and toe;

a width b between the front and back;

a weight W;

a moment of inertia I about a vertical axis of a center of mass of the putter head, wherein $I/Wa^2>0.30$; and a plurality of loads interconnected by at least one connecting element, wherein each of the loads has a load width and a load height, and wherein a ratio of the load height to the load width is at least 3.

4. The putter head of claim 3, wherein $0.30<I/Wa^2\leq 0.50$.

5. A putter head for a putter comprising:

a toe;

a heel;

a front that strikes a ball;

a back opposite the front;

a length a between the heel and toe;

a width b between the front and back;

a weight W;

a moment of inertia I about a vertical axis of a center of mass of the putter head, wherein $I/Wa^2>0.30$; and a plurality of loads interconnected by a plurality of connecting elements, and wherein all connecting elements are placed along a perimeter of the putter head.

6. The putter head of claim 5, wherein $0.30<I/Wa^2\leq 0.50$.

7. A putter head for a putter comprising:

a toe;

a heel;

a front that strikes a ball;

a back opposite the front;

a length a between the heel and toe;

a width b between the front and back;

a weight W; and a moment of inertia I about a vertical axis of a center of mass of the putter head, wherein $I/Wa^2>0.30$; and wherein the putter head has a U-shape with loads at two or more corners or ends of arms of the U-shape.

8. The putter head of claim 7, further comprising vertically oriented connecting elements connecting the loads.

9. The putter head of claim 7, wherein $0.30<I/Wa^2\leq 0.50$.

10. A putter head for a putter comprising:

a toe;

a heel;

a front that strikes a ball;

a back opposite the front;

a length a between the heel and toe;

a width b between the front and back;

a weight W;

a moment of inertia I about a vertical axis of a center of mass of the putter head, wherein $I/Wa^2>0.30$;

a first load at the front of the putter head; and a second load at the back of the putter head, wherein the first load has a first weight, wherein the second load has a second weight, and wherein a ratio of the first weight to the second weight is in the range 1.0 to 1.5, inclusive.

11. The putter head of claim 10, wherein $a\leq 7$ inches and $b\leq a$.

12. The putter head of claim 9, wherein $0.30<I/Wa^2\leq 0.50$.

* * * * *